US007118435B2

(12) United States Patent
Takahashi et al.

(10) Patent No.: US 7,118,435 B2
(45) Date of Patent: Oct. 10, 2006

(54) OUTBOARD MOTOR

(75) Inventors: Masanori Takahashi, Hamamatsu (JP); Yoshibumi Iwata, Hamamtasu (JP); Katsumi Ochiai, Hamamtasu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/999,029

(22) Filed: Nov. 29, 2004

(65) Prior Publication Data

US 2005/0118900 A1 Jun. 2, 2005

(51) Int. Cl.
*B63H 21/38* (2006.01)

(52) U.S. Cl. ..... 440/88 L; 123/196 W

(58) Field of Classification Search ..... 440/88 L, 440/88 R; 123/196 W
See application file for complete search history.

(56) References Cited

U.S. PATENT DOCUMENTS 4,388,896 A * 6/1983 Sheridan et al. ..... 123/73 AD
4,491,103 A * 1/1985 Deadman ..... 123/196 S
4,572,120 A * 2/1986 Matsumoto ..... 123/196 S
4,708,674 A * 11/1987 Matsumoto ..... 440/88 L
4,773,884 A * 9/1988 Matsumoto ..... 440/88 L
5,149,287 A * 9/1992 Koike ..... 440/88 L
5,159,913 A * 11/1992 Furuya ..... 123/493
5,163,394 A * 11/1992 Koishikawa et al. ... 123/196 W
5,192,236 A * 3/1993 Nakamura ..... 440/88 L
5,273,134 A * 12/1993 Hegemier et al. ..... 184/6.4
5,555,857 A * 9/1996 Kanno ..... 123/73 AD
5,924,901 A 7/1999 Takahashi et al.
6,041,892 A 3/2000 Watanabe et al.
6,099,374 A 8/2000 Watanabe et al.
6,371,246 B1 4/2002 Watanabe et al.

* cited by examiner

*Primary Examiner*—Sherman Basinger
(74) *Attorney, Agent, or Firm*—Knobbe, Martens, Olson & Bear, LLP.

(57) ABSTRACT

A system for replenishing a lubricant pan with the lubricant comprises a lubricant tank provided separately from the lubricant pan. A lubricant replenishing pump is provided in the lubricant tank for replenishing the lubricant pan with the lubricant. A lubricant level sensor is adapted to detect the lubricant level in the lubricant tank upon a main switch of an engine being turned on. The lubricant replenishing pump is operated according to the detected lubricant level to replenish the lubricant pan with a specified replenishing amount of the lubricant from the lubricant tank.

18 Claims, 15 Drawing Sheets

OUTBOARD MOTOR

PRIORITY INFORMATION

This application is based on and claims priority under 35 U.S.C. § 119 to Japanese Patent Application No. 2003-396694, filed Nov. 27, 2003, the entire contents of which are hereby expressly incorporated by reference.

BACKGROUND OF THE INVENTION

1. Field of the Invention

This invention relates to an outboard motor, and in particular, to a lubrication system for an outboard motor.

2. Description of the Related Art

An example of a conventional outboard motor is shown in Japanese Publication No. 2003-065174. The outboard motor disclosed in this publication comprises an internal combustion engine, which serves as a drive source and constitutes the upper part of the motor. A propeller constitutes the lower end of the motor and is driven by the engine. A lubricant pan is provided for reserving lubricant (e.g. oil) for the engine. A lubricant feeding pump pressurizes the lubricant in the lubricant pan and feeds the lubricant to various parts of the engine. In this manner, the parts of the engine are lubricated. As is typical with outboard motors, the outboard motor of the publication pivots about a pivot point at its upper part on a boat body so that its lower end can be swung up in a rearward direction and down in forward direction.

Upon starting the engine, the lubricant replenishing pump is actuated to feed lubricant to the various parts of the engine. As mentioned above, in this manner, the various parts of the engine are lubricated to enable continuous operation of the internal combustion engine. With the driving force from the internal combustion engine, the propeller is rotated to propel the boat. During propulsion, the outboard motor is swung back and forth with respect to the pivot point to produce an intended angle relative to the plumb line while the boat is being propelled. In this manner, the propeller remains under the water surface and the altitude of the boat can be changed to attain an intended propulsion state. When the outboard motor is not in use (e.g., as when mooring), the main part of the outboard motor is typically swung up so that the propeller is positioned above the water. When the outboard motor is to be used again, the main part of the outboard motor is swung back down so that the propeller is replaced under the water surface.

It is generally advantageous that an outboard motor be small in size and light in weight. In a similar manner, it is generally advantageous that the lubricant pan of an outboard motor is also made as small as practicable. On the other hand, while the outboard motor is generally required to be of small size and light weight, it is typically operated at high speeds and therefore high output is generally required. Therefore, in many outboard motors, a large amount of lubricant is consumed per unit time. As a result, the lubricant pan must be frequently replenished. The frequent replenishing of the lubricant pan can be cumbersome. If the capacity margin of the lubricant pan is reduced to reduce the size of the outboard motor, the replenishing frequency of replenishing increases.

One solution to the above-mentioned shortcomings is shown in Japanese Patent Applications JP-A-Sho 59-215911 and JP-U-Hei 7-22006. According to these publications, the main part of the outboard motor includes a lubricant tank disposed separately from the lubricant pan for reserving lubricant. A lubricant replenishing pump is provided for transferring lubricant from the lubricant tank to the lubricant pan. The lubricant is automatically fed to the lubricant pan in response to a detection signal if the lubricant level falls below a lower limit while the internal combustion engine is in operation.

However, there are disadvantages with the above described outboard motors. For example, when the internal combustion engine starts operation, the lubricant in the lubricant pan is fed to various parts of the engine, which causes the level of the lubricant in the lubricant pan to be lowered while the engine is in operation. Moreover, during operation, the main part of the outboard motor and the boat that is being propelled are moved in response to the resistance of waves. In addition, the main part of the outboard motor changes its tilt angle at it is swung about its pivot axis. Therefore, the level of the lubricant in the lubricant pan fluctuates and cannot be maintained at a constant level.

In such a situation, the lubricant level in the lubricant pan is largely different from the level that would correspond to the lubricant amount in the whole engine. Therefore, if the lubricant pan is replenished according to the detected lubricant level, the replenishment amount might be too much or not enough.

Therefore, it would be desirable to address the above-noted shortcomings in the prior art and to provide a lubrication system in which a lubricant pan is replenished with the neither too much nor too little lubricant from a lubricant tank disposed separately from the lubricant pan. Another object of the present invention is to provide more effective lubrication for parts of the internal combustion engine to be lubricated.

SUMMARY OF THE INVENTION

Accordingly, one embodiment of the present invention comprises an outboard motor that includes a main part. The main part comprises an internal combustion engine. A lubricant pan is provided for reserving a lubricant for lubricating the engine. A lubricant level sensor detects the level of the lubricant in the lubricant pan. A main switch turns on and off a power supply to the internal combustion engine. A lubricant tank disposed separately from the lubricant pan to reserve the lubricant. A lubricant replenishing pump replenishes the lubricant pan with the lubricant from the lubricant tank. A lubricant replenishing passage leads the lubricant delivered from the lubricant replenishing pump toward the lubricant pan. A control device is operatively connected to the lubricant level sensor and the lubricant replenishing pump. The control device is configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level.

Another embodiment of the present invention comprises a method of replenishing lubricant to a lubricant pan of an outboard motor engine. Before lubricant from the lubricant pan is supplied to parts of the engine, the lubricant level within the lubricant pan is detected. A specified replenishing amount of lubricant is calculated according to the lubricant level. A lubricant pump positioned within a lubricant tank disposed separately from the lubricant pan is activated. The specified replenishing amount of lubricant from the lubricant tank is supplied through a lubricant replenishing passage.

Certain objects and advantages of the invention have been described above for the purpose of describing the invention and the advantages achieved over the prior art. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed

DETAILED DESCRIPTION OF THE PREFERRED EMBODIMENTS

Figure 1:
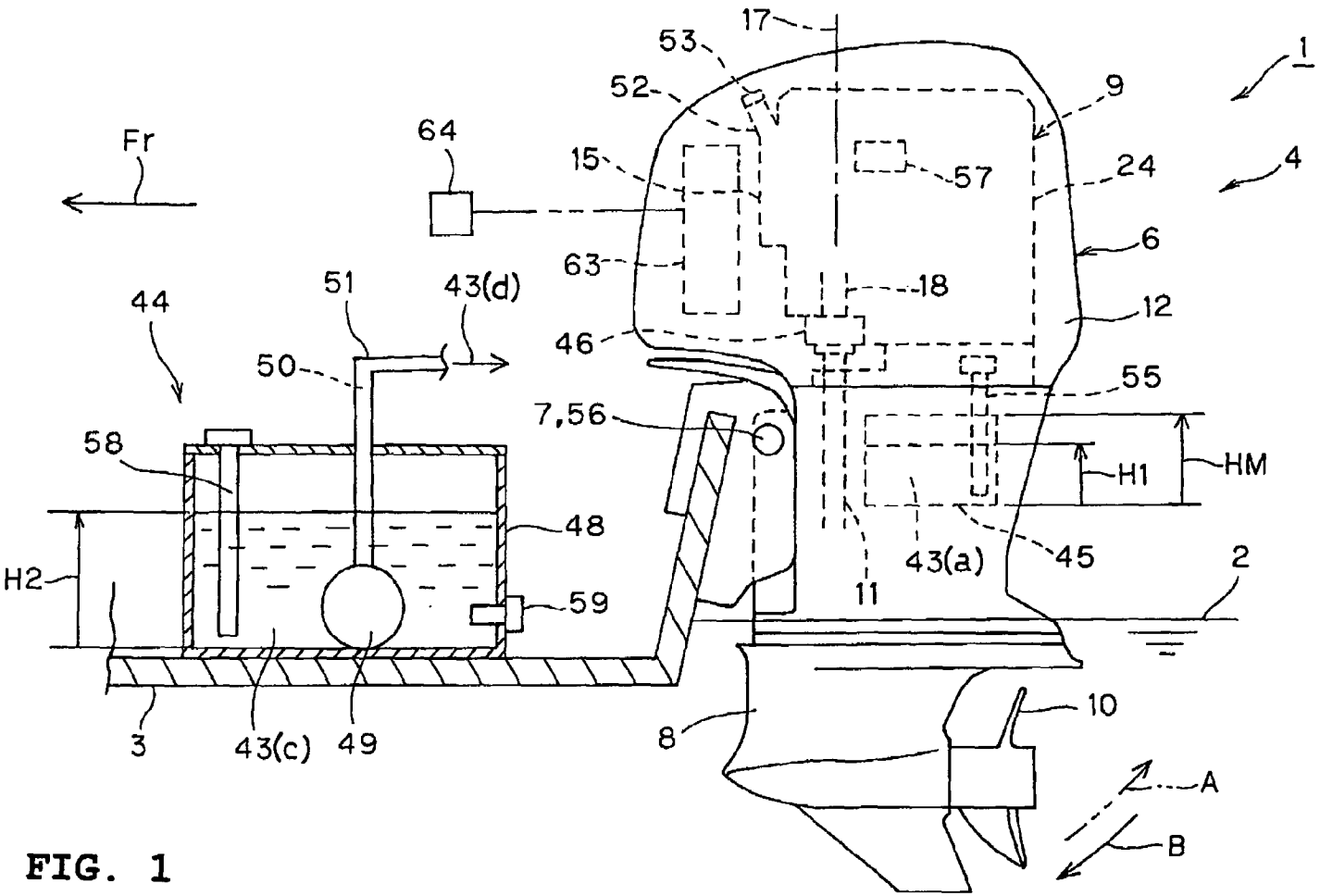
FIG. 1 is a side view of a first embodiment of an outboard motor and a partial, sectional, side view of a boat.

As will be explained in detail below, in one embodiment of the present invention, an outboard motor has a main part. The main part includes an internal combustion engine, which serves as a drive source. A lubricant pan is provided for reserving the lubricant. A lubricant level sensor detects the level of the lubricant in the lubricant pan. A main switch turns on and off power supply to the internal combustion engine. The outboard motor also comprises a lubricant tank disposed separately from the lubricant pan to reserve the lubricant. A lubricant replenishing pump replenishes the lubricant pan with the lubricant from the lubricant tank. A lubricant replenishing passage leads lubricant delivered from the lubricant replenishing pump toward the lubricant pan. The lubricant level sensor detects the lubricant level upon the main switch being turned on and preferably before the lubricant from the lubricant pan is delivered to the parts of the engine to be lubricated. Lubricant from the lubricant tank is supplied by the operation of the lubricant replenishing pump through the lubricant replenishing passage toward the lubricant pan by a specified replenishing amount according to the lubricant level.

This embodiment advantageously automatically feeds lubricant from the lubricant tank towards the lubricant pan with the lubricant replenishing pump according to the lubricant level in the lubricant pan detected with the lubricant level sensor. In addition, at the time the main switch is turned on, the internal combustion engine is in the initial state, (i.e., the state before starting operation). In that state, lubricant in the lubricant pan has not been supplied yet to the various parts of the internal combustion engine to be lubricated. In addition, the boat is typically in a standing, relatively stable state, and the surface of the lubricant in the lubricant pan is therefore kept at a generally constant level without swaying. Thus, because the level of the lubricant is detected upon the main switch being turned on, the actual amount of the lubricant in the lubricant pan can be detected more accurately. Therefore, when the lubricant is delivered from the lubricant tank toward the lubricant pan by the operation of the lubricant replenishing pump according to the lubricant level, the replenishment amount is neither too much nor too little.

In another embodiment, the specified replenishing amount is determined from the difference between the lubricant level detected with the lubricant level sensor and the upper limit level of the lubricant in the lubricant pan. Thus, at the time of starting the internal combustion engine with the main switch being on, the lubricant pan is replenished with the specified replenishing amount up to an appropriate level. In this manner, the internal combustion engine may be operated for a longer period of time.

In another embodiment, a tilt angle sensor is provided to detect the tilt angle of the main part of the outboard motor and the specified replenishing amount of lubricant is determined according to the tilt angle detected with the tilt angle sensor. Therefore, the specified replenishing amount can advantageously be determined with a high accuracy even if the tilt angle of the main part of the outboard motor is not constant and/or not horizontal when the main switch is turned on. Consequently, the amount of lubricant in the pan can be accurately determined without setting the tilt angle of the main part of the outboard motor to a specified value when the main switch is about to be turned on.

In another embodiment, an engine lubricant sensor is provided to detect the temperature of the internal combustion engine upon the main switch being turned on. The lubricant replenishing pump is permitted to operate when the temperature detected with the engine temperature sensor is lower than a specified temperature. After the internal combustion engine is stopped after a long period of operation, the internal combustion engine remains at a high temperature. In addition, when the internal combustion engine is in operation, lubricant is supplied from inside the lubricant pan to various parts of the engine and the lubricant level in the lubricant pan is low. After the engine is stopped, the lubricant level initially remains low because the lubricant supplied to the parts to be lubricated has not returned in sufficient amount to the lubricant pan immediately after stopping operation. However, about the time the temperature of the internal combustion engine becomes lower than a specified value after stopping operation of the internal combustion engine, the lubricant supplied to the parts to be lubricated is thought to return in sufficient amount to the lubricant pan. Thus, in this embodiment, the lubricant replenishing pump is activated when the temperature detected with the engine temperature sensor is lower than a specified value. With the above configuration, the actual amount of the lubricant in the lubricant pan is detected more accurately by the detection of the lubricant level in the lubricant pan. Therefore, when the lubricant pan is replenished with the lubricant from the lubricant tank by the operation of the lubricant replenishing pump according to the lubricant level, the replenishing amount is neither too large nor too small.

In another embodiment, a specified amount of lubricant is supplied from the lubricant tank toward the lubricant pan by operating the lubricant replenishing pump for a specified period of time. In this embodiment, the specified amount of lubricant from the lubricant tank toward the lubricant pan can be delivered without the use of a measuring instrument, such as a flowmeter. Thus, the lubrication system can be simplified. Moreover, since the specified period of time may be set before starting operation of the lubricant replenishing pump, the lubricant is supplied more accurately in the specified amount irrespective of the change, if any, in the lubricant level in the lubricant pan.

In another embodiment, a lubricant temperature sensor for detecting the lubricant temperature in the lubricant tank is provided so as to compensate the specified operation time of the lubricant replenishing pump according to the lubricant temperature. In general, a lubricant's viscosity increases as its temperature is decreased. A higher viscosity, in turn, results in less lubricant being delivered with the lubricant replenishing pump. Therefore, in this embodiment, the specified operation time of the lubricant replenishing pump may be compensated with the lubricant temperature in the lubricant tank, so that the lubricant may be supplied in an amount that is neither too large nor too small from the lubricant tank toward the lubricant pan even if the temperature of the lubricant varies.

In another embodiment, the downstream end of the lubricant replenishing passage is configured to provide lubricant to parts of the engine that are to be lubricated. In one arrangement, the lubricant that is supplied through the lubricant replenishing passage goes directly to the parts to be lubricated before going to the lubricant pan. In this manner, the parts to be lubricated may be lubricated immediately with the lubricant supplied through the lubricant replenishing passage upon the main switch being turned on irrespective of the internal combustion engine being started or not. In other words, the parts to be lubricated are lubricated sufficiently from the start of the internal combustion engine. After that, the lubricant pan is replenished with lubricant as the lubricant is returned to the lubricant pan.

In another embodiment, an outboard motor has an internal combustion engine comprising a crankcase having a crank chamber located above and communicating with the lubricant pan. A crankshaft is supported with the crankcase so as to be placed within the crank chamber and to be rotatable about its longitudinal axis. The downstream end of the lubricant replenishing passage is made open to the radially outside region of the crank main shaft of the crankshaft in the crank chamber. Therefore, when lubricant is supplied from the lubricant tank through the downstream end of the lubricant replenishing passage toward the lubricant pan as the main switch is turned on, the lubricant is supplied first to the radially outside region of the crank main shaft of the crankshaft in the crank chamber and then naturally flows down the crank chamber to replenish the lubricant pan. An advantage of this arrangement is that the radially outside region of the crank main shaft of the crankshaft is the place where less air turbulence and pressure change are present as compared with the radially outside region of crank web and crank pin of the crankshaft. Thus, inflow of the lubricant through the downstream end of the lubricant replenishing passage to the crank chamber is made smooth, so that lubricant is supplied moor smoothly from the lubricant tank toward the lubricant pan.

In addition, if the lubricant supplied toward the lubricant pan were fed directly to the crank web and the crank pin of the crankshaft, the lubricant would rotate together with the crank web and the crank pin and might cause useless power loss. However, since the crank main shaft of the crankshaft rotates about its axis and the lubricant from the lubricant tank is supplied to the radially outside region of the crank main shaft of the crankshaft in the crank chamber, such useless power loss due to the lubricant rotating together with them is prevented from occurring.

In another embodiment, an outboard motor has an internal combustion engine comprising a crankcase, a cylinder projecting from the crankcase, and a cam chamber formed inside the projecting part of the cylinder. A downstream end of the lubricant replenishing passage opens to the cam chamber. Therefore, the parts to be lubricated in the cam chamber may be lubricated with lubricant supplied through the lubricant replenishing passage immediately after the main switch is turned on irrespective of the internal combustion engine being started or not. In other words, the parts to be lubricated are lubricated sufficiently from the start of the internal combustion engine. After that, the lubricant flows down the cam chamber to replenish the lubricant pan.

In another embodiment, an outboard motor has an internal combustion engine comprising a cylinder projecting generally horizontally from the crankcase, wherein a space communicating with the lubricant pan is formed within the cylinder and the downstream end of the lubricant replenishing passage is made open to the space. In this embodiment, the space is the place where less air turbulence and pressure change are present, inflow of lubricant through the downstream end of the lubricant replenishing passage to the space is made smooth, so that subsequently thereafter lubricant naturally flows down the space to replenish the lubricant pan. Therefore, the lubricant is supplied smoothly from the lubricant tank toward the lubricant pan.

In another embodiment, an outboard motor has an internal combustion engine comprising a crankcase, a crankshaft placed within and supported with the crankcase so as to be rotatable about its vertical axis, a cylinder projecting generally horizontally from the crankcase, cam shafts placed within the cam chamber in the projecting part of the cylinder, and interlock device for connecting the camshafts to the crankshaft. The interlock device is placed in a lower space formed between the lower parts of the crank chamber and the cam chamber, and the downstream end of the lubricant replenishing passage is made open to the lower space. Therefore, irrespective of whether or not the internal combustion engine is started, one of the parts in the cam chamber to be lubricated (e.g., the interlock device) is lubricated with lubricant supplied through the lubricant replenishing passage immediately after the main switch is turned on. In other words, the parts to be lubricated are lubricated sufficiently from the time the internal combustion engine is started. After that, lubricant naturally flows down the lower space to replenish the lubricant pan.

The lower space, may be formed with respective lower parts of the crank chamber and the cam chamber, this results in being located near the lubricant pan. Therefore, the lubricant supplied through the lubricant replenishing passage to the lower space is supplied quickly thereafter to the lubricant pan. Therefore, it is possible to feed the lubricant quickly in sufficient amount from the lubricant pan also to other parts to be lubricated.

In another embodiment of the invention, an outboard motor has an internal combustion engine comprising a blow-by gas passage for making mutual communication between the crank chamber and the cam chamber. The downstream end of the lubricant replenishing passage is made open to the blow-by gas passage.

In this embodiment, since the blow-by gas passage is the place where less air turbulence and pressure change are present, inflow of the lubricant through the downstream end of the lubricant replenishing passage to the blow-by gas passage is made smooth, so that subsequently the lubricant naturally flows down through at least one of the crank chamber and the cam chamber to replenish the lubricant pan. Therefore, the lubricant is supplied smoothly from the lubricant tank toward the lubricant pan.

Another embodiment of the invention, relates to a method and apparatus for replenishing lubricant pan disposed in the outboard motor with the lubricant in amount that is neither too much nor too little from an lubricant tank disposed separately from the lubricant pan. The main part of an outboard motor comprises an internal combustion engine serving as a drive source, a lubricant pan for reserving the lubricant, a lubricant level sensor for detecting the level of the lubricant in the lubricant pan, and a main switch for turning on and off power supply to the internal combustion engine. The outboard motor also comprises a lubricant tank disposed separately from the lubricant pan and capable of reserving the lubricant. A lubricant replenishing pump for replenishing the lubricant pan with the lubricant from the lubricant tank, and a lubricant replenishing passage for guiding the lubricant delivered from the lubricant replenishing pump toward the lubricant pan are also provided. A lubricant level sensor is adapted to detect the lubricant level as the main switch is turned on, and specified amount of the lubricant can be fed by the operation of the lubricant replenishing pump according to the lubricant level from the lubricant tank toward the lubricant pan.

The above embodiments will now be described in greater detail with reference to the exemplary embodiments which are shown in FIGS. 1–15.

Figure 2:
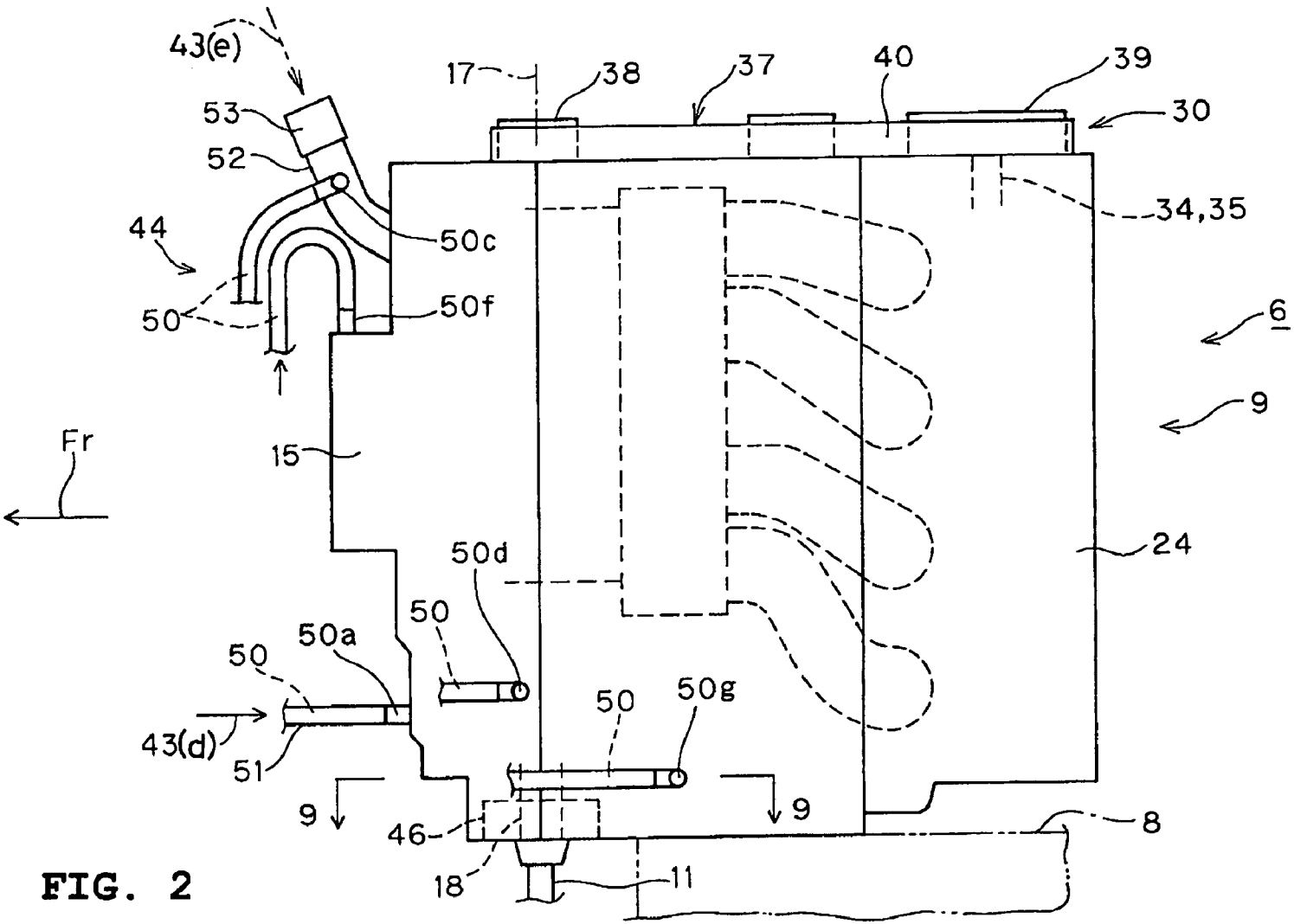
FIG. 2 is a side elevational view of an internal combustion engine of the outboard motor of FIG. 1.
Figure 3:
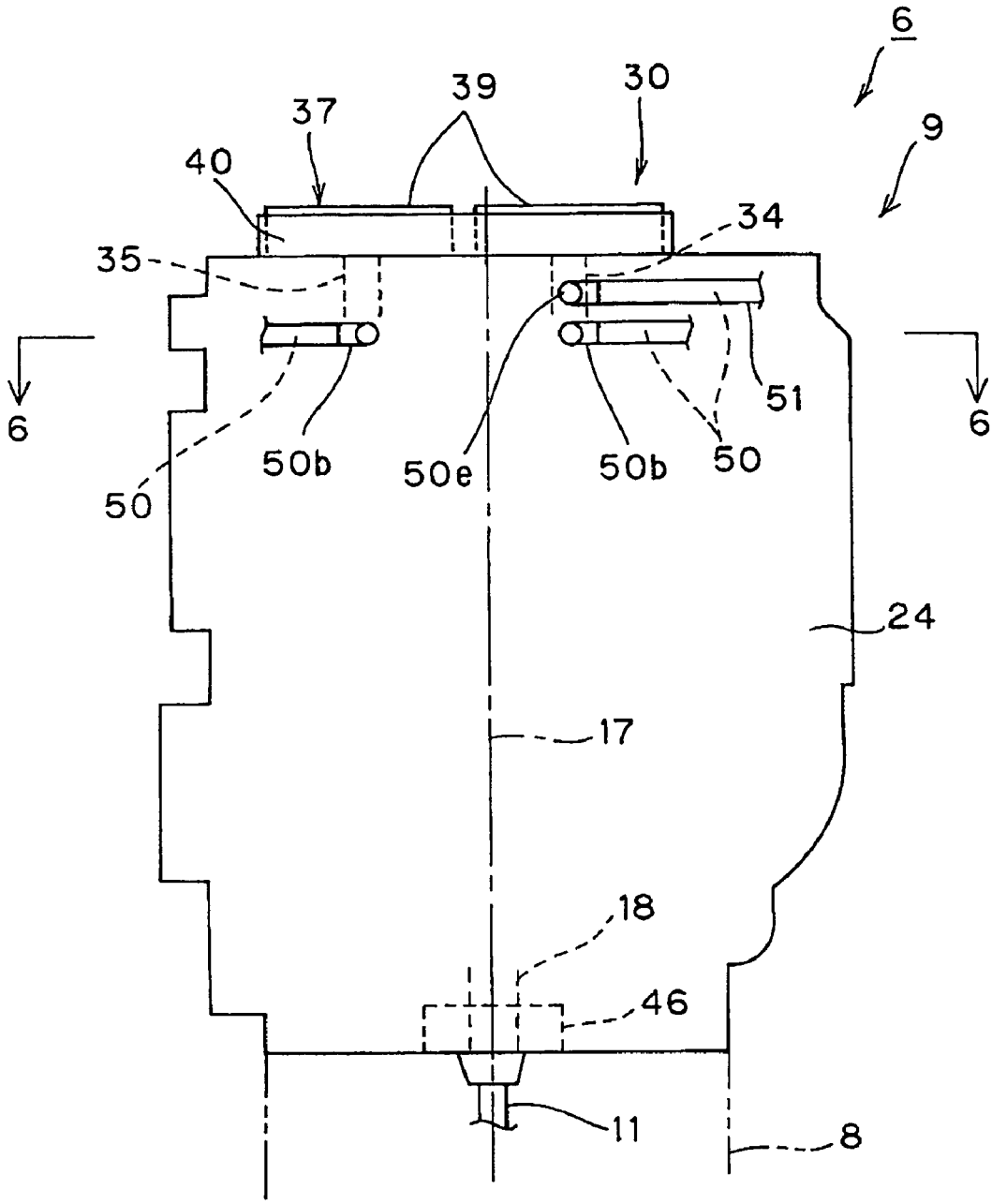
FIG. 3 is a back elevational view of the internal combustion engine.

With initial reference to FIGS. 1–3, reference numeral 1 denotes an exemplary boat comprising a boat body 3 floating on water 2. An exemplary outboard motor 4 is supported on the boat body 3 so that the boat body 3 can be propelled. The arrow Fr in the drawings indicates the forward direction of the boat body 3.

The outboard motor 4 comprises a main part 6, which as describe below is a source of power for propelling the body 3 of a watercraft (e.g., a boat). The outboard motor main part 6 extends generally in the vertical direction. The outboard motor main part 6 comprises a casing or case 8, which is pivoted with about a pivot member 7 on the rear part of the boat body 3. An internal combustion engine 9 or a drive source forms the upper part of the outboard motor main part 6 and is supported on the top face of the case 8. A propeller 10 is supported by the lower end part of the case 8. A transmission 11 is provided for coupling the propeller 10 with the internal combustion engine 9. The upper part of the case 8 of the main part 6 is pivoted on the boat body 3 using the pivot member 7 so that the lower end part of the main part 6 may be sunk below the water surface 2 together with the propeller 10 and that the main part 6 may also be swung up rearward and down forward (see arrows A and B in FIG. 1) about the pivot member 7.

As used in this description, the term "horizontally" means that the subject portions, members or components extend generally in parallel to the water line 2 when the associated watercraft or boat is substantially stationary with respect to the water line 2 and when the case is not tilted and is placed in the position shown in FIG. 1. The term "vertically", in turn, means that portions, members or components extend generally normal to those that extend horizontally.

With reference to FIGS. 1–6, the internal combustion engine 9 of the exemplary embodiment is of a four-stroke cycle (i.e. operates on a four cycle combustion principle), multi-cylinder type that comprises a crankcase 15 supported on the top face of the case 8, and a crankshaft 18 supported with the crankcase 15 so as to be placed within the crank chamber 16 in the crankcase 15 and to be rotatable about its vertical axis 17. The crankshaft 18 comprises a crank main shaft 20 aligned with the axis 17 and supported through bearings 19 with the crankcase 15. Crank webs 21 project vertically outward from the crank main shaft 20. Crankpins 22 are supported at the projected end parts of the crank webs 21.

The internal combustion engine 9 of the exemplary embodiment also comprises a cylinder body 24 that projects rearward from the crankcase 15. Pistons 28 are positioned within cylinder bores 27 formed in the cylinder body 24 and are configured for slidable movement in a axial direction. Connecting rods 29 interconnect the crankpins 22 of the crankshaft 18 with the pistons 28. A valve driving mechanism 30 is provided for opening and closing intake and exhaust valves (not shown) provided in the cylinder 24.

The valve driving mechanism 30 is made up of the cam chamber 33 formed in the projecting part of the cylinder body 24. Camshafts 34, 35 are housed in the cam chamber 33 and extend parallel to the crankshaft 18. Lifters 36 interlock the camshafts 34, 45 with the intake and exhaust valves. An interlock device 37, preferably of an endless belt girdling type, is provided for interlocking the crankshaft 18 with the camshafts 34, 35. The interlock device 37 in the illustrated embodiment comprise a drive pulley 38 coupled to the top end part of the crankshaft 18. Driven pulleys 39 are coupled to the top end parts of the camshafts 34,35. An endless timing belt 40 is routed around the drive pulley 38 and the driven pulleys 39.

As mentioned above, the engine 9 in the illustrated embodiment preferably operates on a four-cycle combustion principle. This type of engine, however, merely exemplifies one type of engine on which various aspects and features of the present invention can be suitably used. Engines having other numbers of cylinders and having other cylinder arrangements (V, W, opposing, etc.) also can employ various features, aspects and advantages of the present invention. In addition, the engine can be formed with separate cylinder bodies rather than a number of cylinder bores formed in a cylinder block. In addition, as explained below, the engine 9 has particular utility in the context of a marine drive, such as the outboard motor, and thus is described in the context of an outboard motor. The engine 9, however, can be used with other types of marine drives (i.e., inboard motors, inboard/outboard motors, jet drives, etc.) and also certain land vehicles. In any of these applications, the engine 9 can be oriented vertically or horizontally. Furthermore, the engine 9 can be used as a stationary engine for some applications as is apparent to those of ordinary skill in the art in light of the description herein.

Figure 7:
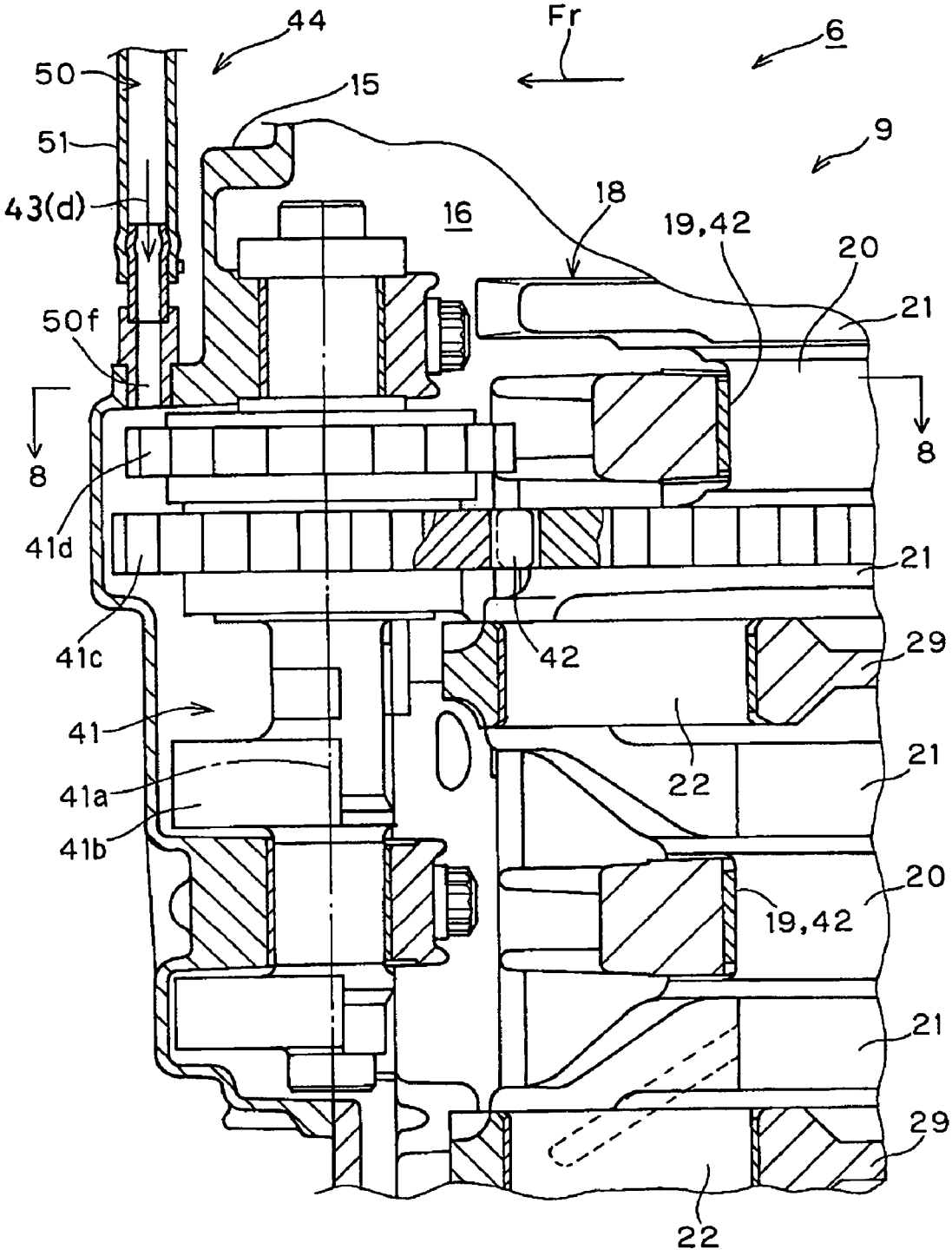
FIG. 7 is a partial, enlarged, side cross-sectional of a crankshaft and balancer the engine of FIG. 1.
Figure 8:
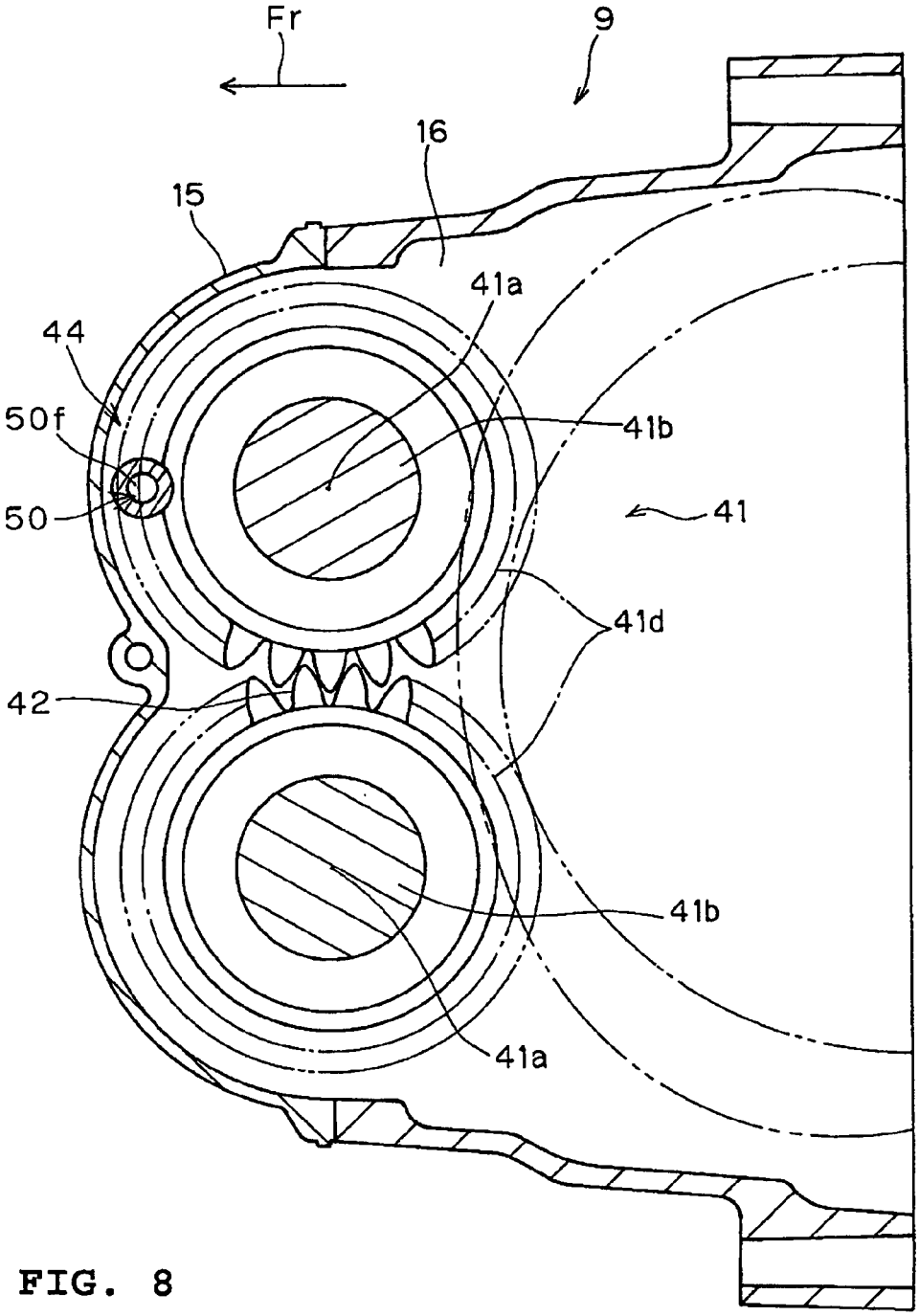
FIG. 8 is a cross-sectional view as seen in the direction of arrows 8—8 in FIG. 7.

As shown in FIGS. 7 and 8, the internal combustion engine 9 of the illustrated embodiment is provided with a balancer 41. The balancer 41 comprises a pair of balancer shafts 41*b*, 41*b* supported with the crankcase 15 so as to be rotatable about their respective axes 41*a*, 41*a* extending parallel to the crankshaft 18. A mating gear set 41*c* is provided for interlocking the balancer shaft 41*b* with the crankshaft 18. Another mating gear set 41*d* is provided for mutually interlocking the balancer shafts 41*b*, 41*b*.

As shown in FIGS. 1 to 9, the outboard motor 4 is provided with a lubricating device 44 for lubricating various parts 42 of the internal combustion engine 9 by feeding a lubricant 43 to the various parts 42.

The illustrated lubricating device 44, to be described in more detailed below, comprises a lubricant pan 45, a lubricant feeding pump 46, a lubricant tank 48, a lubricant replenishing pump 49, a lubricant tube 51, a lubricant filler neck 52, a cap 53, a baffle plate 54, a lubricant level sensor 55, a tilt angle sensor 56, an engine temperature sensor 57, a lubricant level sensor 58, and a lubricant temperature sensor 59. Other components of the lubricating device 44 will also be described in detail below.

The parts 42 to be lubricated by the lubricating device 44 are any of a variety of components of the engine 9, such as, for example, the bearings 19, and contacting parts between camshafts 34, 35 and lifters 36. In the illustrated embodiment, a portion of the lubricating device 44 may be provided inside the case 8. Such portions may include the lubricant pan 45 to hold the lubricant 43(*a*), and the lubricant feeding pump 46 for pressurizing the lubricant 43(*a*) and feeding it to the parts 42 to be lubricated.

In the illustrated embodiment, the crank chamber 16 is in a higher position than the lubricant pan 45. The bottom portion of the crank chamber 16 is in communication with the lubricant pan 45. Lubricant 43(*b*) in the crank chamber 16 therefore may be allowed to naturally flow down into the lubricant pan 45. The lubricant feeding pump 46 is placed on the axis 17 of the crankshaft 18 and interlocked with the crankshaft 18.

The lubricating device 44 also comprises the lubricant tank 48, which is disposed separately from the lubricant pan 45 for reserving lubricant 43(*c*). The lubricant replenishing pump 49 is arranged for feeding the lubricant 43(*c*) in the lubricant tank 48 toward the lubricant pan 45. The lubricant tube 51 provides a lubricant replenishing passage 50 for guiding lubricant 43(*d*) delivered from the lubricant replenishing pump 49 toward the lubricant pan 45. The lubricant tank 48 is preferably capable of changing its position in the front and rear directions on the boat body 3. The lubricant tube 51 is preferably flexible.

The illustrated lubricating device 44 also comprises the lubricant filler neck 52 (see FIG. 2) provided at the front upper part of the crankcase 15 to permit pouring of lubricant 43(*e*) through the crank chamber 16 into the lubricant pan 45. The cap 53 is attached to the lubricant filler neck 52 so that it can be opened and closed. The baffle plate 54 (see e.g., FIG. 4) may be made of sheet metal and is supported by the crankcase 15 and placed along the outside round surface of the rotary locus of the crankshaft 18. The baffle plate 54 divides the interior of the crank chamber 16 into a region on the side of the inside surface of the crankcase 15 and a region on the crankshaft 18 side. The baffle plate 54 prevents the lubricant 43(*b*) present in the region on the side of the inside surface of the crankcase 15 from being uselessly rotated together with the crankshaft 18.

As mentioned above, in the illustrated embodiment, the lubricating device 44 also comprises the lubricant level sensor 55 for detecting the level H1 of lubricant 43(*a*) in the lubricant pan 45, and the tilt angle sensor 56 for detecting the tilt angle when the main part 6 tilts from the "upright condition" (FIG. 1) in which the crankshaft 18 of the main part 6 is positioned along the plumb line. The lubricating device 44 also includes the engine temperature sensor 57 for detecting the temperature of the internal combustion engine 9, the lubricant level sensor 58 for detecting the level H2 of the lubricant 43(*c*) in the lubricant tank 48, and the lubricant temperature sensor 59 for detecting the temperature of the lubricant 43(*c*) in the lubricant tank 48. In the illustrated embodiment, the engine temperature sensor 57 may be one that detects indirectly the temperature of the internal combustion engine 9. For example, signals may be obtained by sensing the temperature of air taken into the internal combustion engine 9. In addition, the lubricant temperature sensor 59 may also detect indirectly the temperature of lubricant 43(*c*) in the lubricant tank 48. For example, signals obtained by sensing the ambient temperature about the engine may be used.

A control device 63 is provided to control various functions and aspects of the engine 9, such as the lubricant device 44. The lubricant level sensors 55, 56, 57, 58, 59 are operatively connected (e.g., electrically connected) to the control device 63. A main switch 64 is provided for turning on and off power supply from a power source (e.g., a battery) to the control device 63 and other electric components of the internal combustion engine.

The control device 63 preferably has a central processing unit (CPU) and some storage units which store various control maps defining relationships between parameters such as, the ones identified below. The control device 63 may also comprise a hard-wired circuit, a dedicated processor and memory, and/or a general purpose processor and memory running one or a plurality of control programs. Various components are described as being "operatively connected" to the control device 63. It should be appreciated that this is a broad term that includes physical connection (e.g., electrical wires) and non-physical connections (e.g., radio or infrared signals).

As the internal combustion engine 9 operates, the valve driving mechanism 30 interlocks with the crankshaft 18 of the internal combustion engine 9 to open and close the intake and exhaust valves as appropriate to perform respective strokes as is well known in the art of four-cycle engines. Also the lubricant feeding pump 46 may be interlocked with the crankshaft 18 and operates to feed lubricant 43 in the lubricant pan 45 to various parts 42 to be lubricated. In this manner, the operation of the internal combustion engine 9 may be continued as the parts 42 are lubricated. The driving force outputted from the internal combustion engine 9 is used to rotate the propeller 10 and propel the boat 1.

The main part 6 of the outboard motor may be swung up and down (see arrows A and B in FIG. 1) to produce an intended angle relative to the plumb line while the boat 1 is being propelled in order to maintain the propeller 10 under the water surface 2 and to change the altitude of the boat 1 to attain an intended propulsion state. In addition, when the outboard motor 4 is not in use (e.g., when mooring), the main part 6 of the outboard motor is typically swung up (e.g., as shown by the arrow A in FIG. 1) so that the propeller 10 is positioned above the water surface 2. When the outboard motor 4 is to be used again, the main part 6 of the outboard motor is swung down (shown as the arrow B) so that the propeller 10 is replaced under the water surface 2.

As the operation of the internal combustion engine 9 continues, lubricant 43 in the lubricant pan 45 is consumed.

As the lubricant is consumed, lubricant is replenished from the lubricant tank 48 toward the lubricant pan 45 by the operation of the lubricant replenishing pump 49 controlled with the control device 63.

Figure 10:
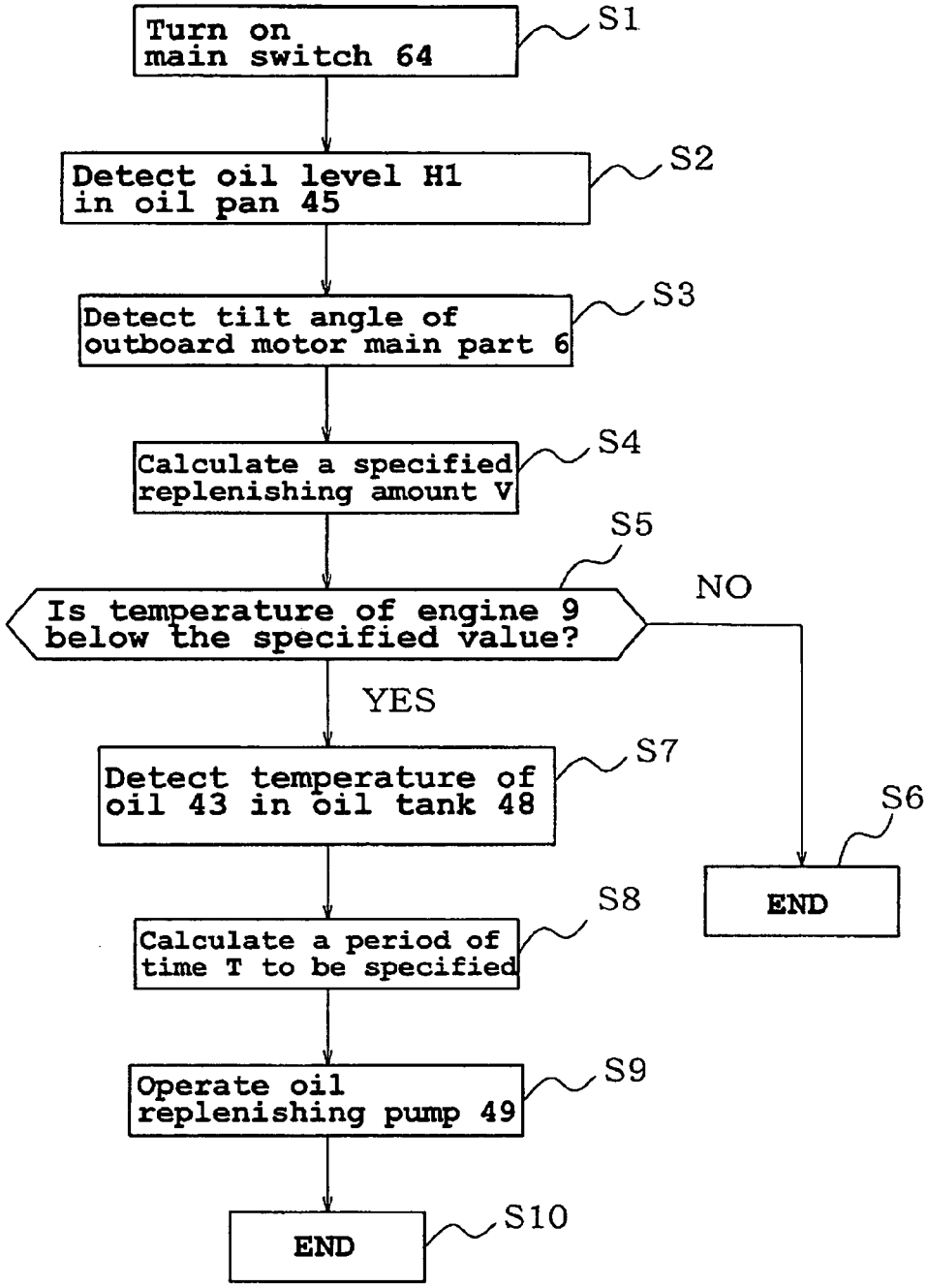
FIG. 10 is a flow chart of an embodiment of a control routine for a control device for the engine of FIG. 1.

FIG. 10 is a flow chart illustrating a control routine that may be used by the control device 63 to replenish the lubricant pan 45 with additional lubricant. In the FIG. 10, the symbol S denotes respective steps of a program. It is anticipated that one or more of the various steps described above may be rearranged, combined and/or eliminated to create other embodiments of the invention.

As shown in FIG. 10, in step S1, it is determined if the main switch 64 is turned on. If the main switch 64 is turned on, then the routine moves to step S2. In step S2, the level H1 of lubricant 43 in the lubricant pan 45 is detected with the lubricant level sensor.

The routine then moves onto step S3 where it is determined if the outboard motor main part 6 is tilted up from the "upright condition." As explained above, as the main part 6 is tilted, the value of the lubricant level H1 detected with the lubricant level sensor 55 may vary even if the amount of the lubricant 43(*a*) held in the lubricant pan 45 is constant. Therefore, in step S3, the tilt angle of the motor main part 6 is detected with the tilt angle sensor 56.

In step S4, a specified replenishing amount V of lubricant 43 to be replenished through the lubricant replenishing passage 50 from the lubricant tank 48 toward the lubricant pan 45 is calculated. In one embodiment, the replenishing amount V is calculated on the basis of the difference between the value of the lubricant level H1 detected in step S2 and a value of the upper limit lubricant level HM (HM=H1), which may be stored in advance in the control device 63. The specified replenishing amount V may also be compensated by the tilt angle of the main part 6, which is detected in step S3. In this manner, the replenishing amount V to be specified in step S4 is more accurate as compared to a calculation based only on the detected lubricant level in S2.

In step S5, the temperature of the internal combustion engine 9 is detected with the engine temperature sensor 57. In this step, it is determined if the temperature of the internal combustion engine 9 as detected by the engine temperature sensor 57 exceeds a specified temperature that is preferably not lower than the ambient temperature. The specified temperature may be stored in advance in the control device 63. If the detected engine temperature is not lower the specified value, then the controlling the operation of the lubricant replenishing pump 49 with the control device 63 is completed (see step S6). On the other hand, if the temperature of the internal combustion engine 9 detected with the engine temperature sensor 57 does not exceed the specified temperature, the routines moves onto step S7. In this manner, the lubricant in the pan is not replenished if the temperature of the engine is above a specified value. As discussed above, when the engine temperature is higher than the specified value, it has been determined that the lubricant in the lubricant pan 45 may be low because a significant amount of lubricant remains in the engine and has not returned to the lubricant pan 45.

In step S7, the temperature of the lubricant 43 in the lubricant tank 48 is detected with the lubricant temperature sensor 59. From step S7, the routine moves to S8 where the specified replenishing amount V calculated in the step S4 is supplied by the operation of the lubricant replenishing pump 49 from the lubricant tank 48 toward the lubricant pan 45 through the lubricant replenishing passage 50. In this step, a period of time T to be specified for operating the lubricant replenishing pump 49 to supply the specified replenishing amount V is calculated on the basis of the capacity of the lubricant replenishing pump 49. Also in this step, the specified period of time T may be compensated to be shorter or longer according to the value of viscosity of the lubricant 43, which may change based on the detected temperature of the lubricant 43. In this manner, the period of time T to be specified may be made more accurate.

The routine may then move onto step S9 where the lubricant replenishing pump 49 is operated for the specified period of time T as determined in step S8. The specified replenishing amount V of the lubricant 43 is therefore supplied from the lubricant tank 48 toward the lubricant pan 45, so that the consumed amount of the lubricant 43 is replenished. The routine may then be ended by moving to step S10 and control of the lubricant replenishing pump 49 is completed.

An alarm device may be provided to produce an alarm (e.g., an audio or visual indicator) to prompt a boat operator to replenish the lubricant tank 48 with lubricant 43 when the lubricant level sensor 58 detects that the lubricant level H2 of the lubricant 43 in the lubricant tank 48 is not higher than a specified lower limit value. Another alarm device may be provided to produce an alarm to prompt the boat operator to replenish the lubricant tank 48 with the lubricant 43 when the lubricant level sensor 55 detects that the lubricant level H1 of the lubricant 43 in the lubricant pan 45 is not higher than a specified lower limit value. In some embodiments, the lower limit values of the lubricant levels H1, H2 in the tank 48 and pan 45 may be detected with a sensor such as a residual amount limit switch. In addition, in some embodiments, only one or neither of the alarm devices may be provided.

In the embodiments described above, the lubricant level H1 may be detected simultaneously with turning on the main switch 64 and/or the lubricant level H1 may also be detected after a certain time from turning on the main switch 64 using a timer or the like. In either embodiment, the lubricant level H1 is preferably detected before lubricant from the lubricant pan 45 is delivered to the parts 42 of the engine 9 to be lubricated.

In the above described embodiment, the lubricant tank 48 is disposed separately from the lubricant pan 45 and is capable of reserving lubricant 43. The lubricant replenishing pump 49 is capable of supplying lubricant 43 in the lubricant tank 48 toward the lubricant pan 45 through the lubricant replenishing passage 50. The lubricant level sensor 55 detects the lubricant level H1 upon the main switch 64 being turned on, and the specified amount V of the lubricant 43 is supplied automatically through the lubricant replenishing passage 50 from the lubricant tank 48 toward the lubricant pan 45 as the lubricant replenishing pump 49 is operated according to the lubricant level H1.

The above described embodiments have several advantages. For example, the lubricant tank 48 is replenished in advance with lubricant 43, as the lubricant 43 is automatically supplied by the operation of the lubricant replenishing pump 49 from the lubricant tank 48 toward the lubricant pan 45 according to the lubricant level H1 in the lubricant pan 45 as detected with the lubricant level sensor 55.

When the main switch 64 is turned on, the internal combustion engine 9 is typically in an initial state, i.e., the state before starting operation. In that state, the lubricant 43 in the lubricant pan 45 has not been supplied yet to various parts 42 of the internal combustion engine 9 to be lubricated. In addition, the boat 1 typically is in a standing state, and the surface of the lubricant 43 in the lubricant pan 45 is kept at a nearly constant level without swaying. Thus, because the lubricant level H1 in the lubricant pan 45 is detected upon the main switch 64 being turned on, the actual amount of lubricant 43 in the lubricant pan 45 is detected more accurately. Therefore, when the lubricant 43 is supplied by the operation of the lubricant replenishing pump 49 from the lubricant tank 48 toward the lubricant pan 45 according to the lubricant level H1, the supplied amount is neither too much nor too little.

In addition, as described above, in some embodiments, the specified replenishing amount V is determined according to the difference between the lubricant level H1 detected with the lubricant level sensor 55 and the upper limit lubricant level HM of lubricant 43 in the lubricant pan 45. Therefore, the lubricant pan 45 is replenished appropriately with the specified replenishing amount V at the time the internal combustion engine 9 is started while the main switch 64 is on. Therefore, the internal combustion engine 9 may operate for a longer period of time. In other words, the boat 1 may be propelled continuously for a longer period of time.

As described above, another advantage is that the tilt angle sensor 56 may be provided to detect the altitude or tilt angle of the main part 6 from the "upright state" so as to determine the specified replenishing amount V of the lubricant 43 according to the tilt angle detected with the tilt angle sensor 56. Therefore, the specified replenishing amount V may be determined more accurately even if the tilt angle of the main part 6 is not constant at the time the main switch 64 is turned on. Therefore, the outboard motor main part 6 does not need to be set to a specified tilt angle every time the main switch 64 is about to be turned on. This further enhances the replenishing operations.

Another advantage of some of the embodiments described above is that the engine temperature sensor 57 may be used for detecting the temperature of the engine 9 when the main switch 64 is turned on so that the operation of the lubricant replenishing pump 49 is permitted when the temperature detected with the engine temperature sensor 57 is not higher than the specified temperature. As explained above, since sufficient heat radiation is not made immediately after the internal combustion engine 9 is stopped, after a long period thereof the internal combustion engine 9 remains at a high temperature. In addition, when the internal combustion engine 9 is in operation, the lubricant 43 is supplied from inside the lubricant pan 45 to various parts 42 to be lubricated, causing the lubricant level H1 in the lubricant pan 45 to be low. After the engine 9 is stopped, the lubricant 43 does not return immediately to the lubricant pan 45. However, about the time the temperature of the internal combustion engine 9 becomes not higher than a specified value with the lapse of time after stopping operation of the internal combustion engine 9, the lubricant 43 supplied to the parts 42 to be lubricated is thought have returned in sufficient amount to the lubricant pan 45. The specific value may be determined by empirical data, calculated or estimated from observation. This embodiment advantageously provides that the amount of lubricant 43 in the lubricant pan 45 is more accurately detected by the detection of the lubricant level H1, so that the specified replenishing amount V may also be determined more accurately. Therefore, when the lubricant pan 45 is replenished with lubricant 43 from the lubricant tank 48 by the operation of the of the lubricant replenishing pump 49 according to the lubricant level H1, the replenishing amount is made neither too much nor too little.

Another advantage is that the specified replenishing amount V of the lubricant 43 may be supplied from the lubricant tank 48 toward the lubricant pan 45 by operating the lubricant replenishing pump 49 for the specified period of time T. In such an embodiment, the specified amount V of the lubricant 43 from the lubricant tank 48 toward the lubricant pan 45 can be supplied without a measuring instrument such as a flowmeter. This simplifies the lubrication system. Moreover, since the specified period of time T is set before starting operation of the lubricant replenishing pump 49, the lubricant 43 is supplied thereafter securely in the specified amount V irrespective of the change, if any, in the lubricant level H1 in the lubricant pan 45.

Another advantage is that the lubricant temperature sensor 59 may be provided to detect the temperature of the lubricant 43 in the lubricant tank 48 to compensate the specified period of time T for operating the lubricant replenishing pump 49 according to the temperature of the lubricant 43 detected with the lubricant temperature sensor 59. As explained above, in general, the lower the lubricant 43 temperature, the higher its viscosity and the less amount tends to be delivered with the lubricant replenishing pump 49. Thus, even if the temperature of the lubricant 43 varies, by compensating the specified operation time T of the lubricant replenishing pump 49 with the temperature of lubricant 43 in the lubricant tank 48, the lubricant 43 may be supplied in a more accurate manner that is neither too large nor too small from the lubricant tank 48 toward the lubricant pan 45.

Figure 4:
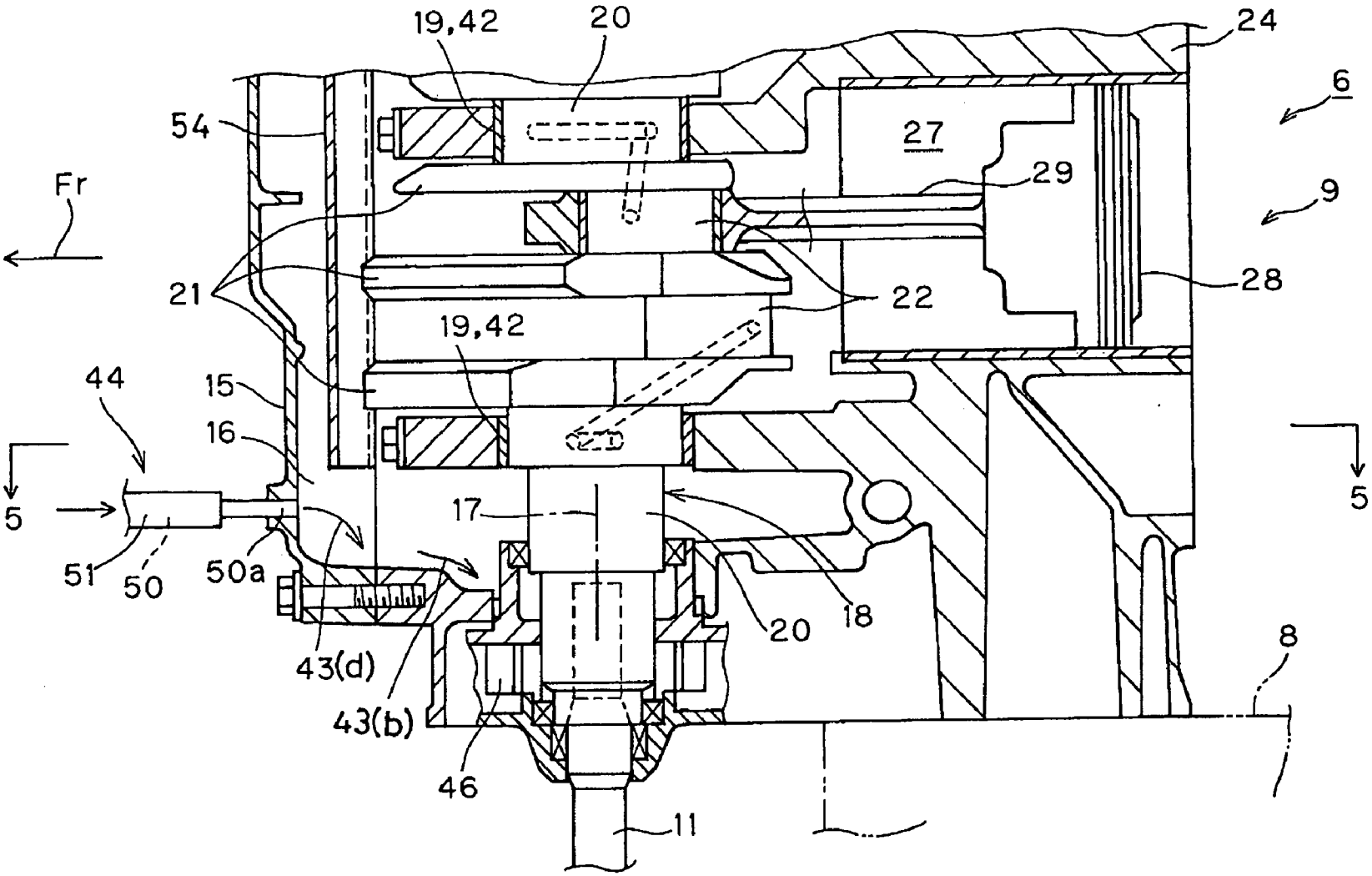
FIG. 4 is a partial, side cross-sectional view of a lower portion of FIG. 3.
Figure 5:
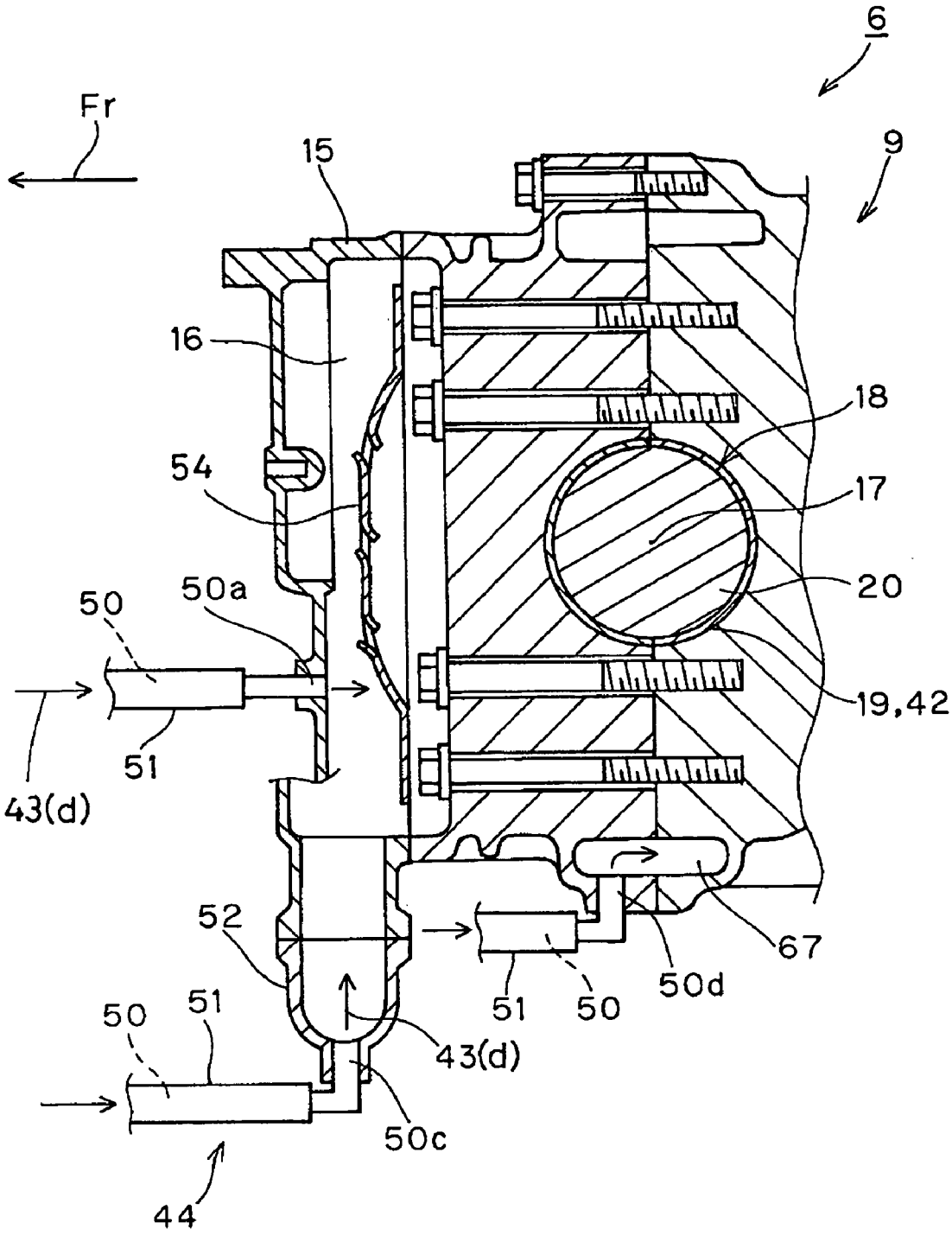
FIG. 5 is a cross-sectional view as seen in the direction of arrows 5—5 in FIG. 4.

As shown in FIGS. 2, 4 and 5, in the illustrated embodiment, a downstream end 50*a* of the lubricant replenishing passage 50 is made to open in the region that is on the radially outside of the crank main shaft 20 of the crankshaft 18 in the crank chamber 16 and that is on the side of the inside surface of the crankcase 15 partitioned with the baffle plate 54.

Therefore, when lubricant 43 is supplied, upon the main switch 64 being turned on, from the lubricant tank 48 toward the lubricant pan 45 through the downstream end 50*a* of the lubricant replenishing passage 50, the lubricant 43 is first supplied to the radially outside region of the crank main shaft 20 in the crank chamber 16 and then naturally flows down the crank chamber 16 to replenish the lubricant pan 45. Since the region that is radially outside the crank main shaft 20 in the crank chamber 16 and in the inside surface side of the crankcase 15 is the place where less air turbulence and pressure change are present as compared with the radially outside region of the crank webs 21 and the crank pins 22 of the crankshaft 18, inflow of the lubricant 43 through the downstream end 50*a* of the lubricant replenishing passage 50 to the crank chamber 16 is made smooth, so that the lubricant 43 is supplied smoothly from the lubricant tank 48 toward the lubricant pan 45.

In contrast, if lubricant 43 supplied toward the lubricant pan 45 were fed directly to the crank web 21 and the crank pin 22 of the crankshaft 18, the lubricant 43 would rotate together with the crank web 21 and the crank pin 22. This might cause useless power loss. However, in the illustrated embodiment, since the crank main shaft 20 of the crankshaft 18 rotates about its axis 17 and the lubricant 43 from the lubricant tank 48 is supplied to the radially outside region of the crank main shaft 20 of the crankshaft 18 in the crank chamber 16, the useless power loss due to the lubricant 43 rotating together with them is prevented from occurring or reduced.

Figure 6:
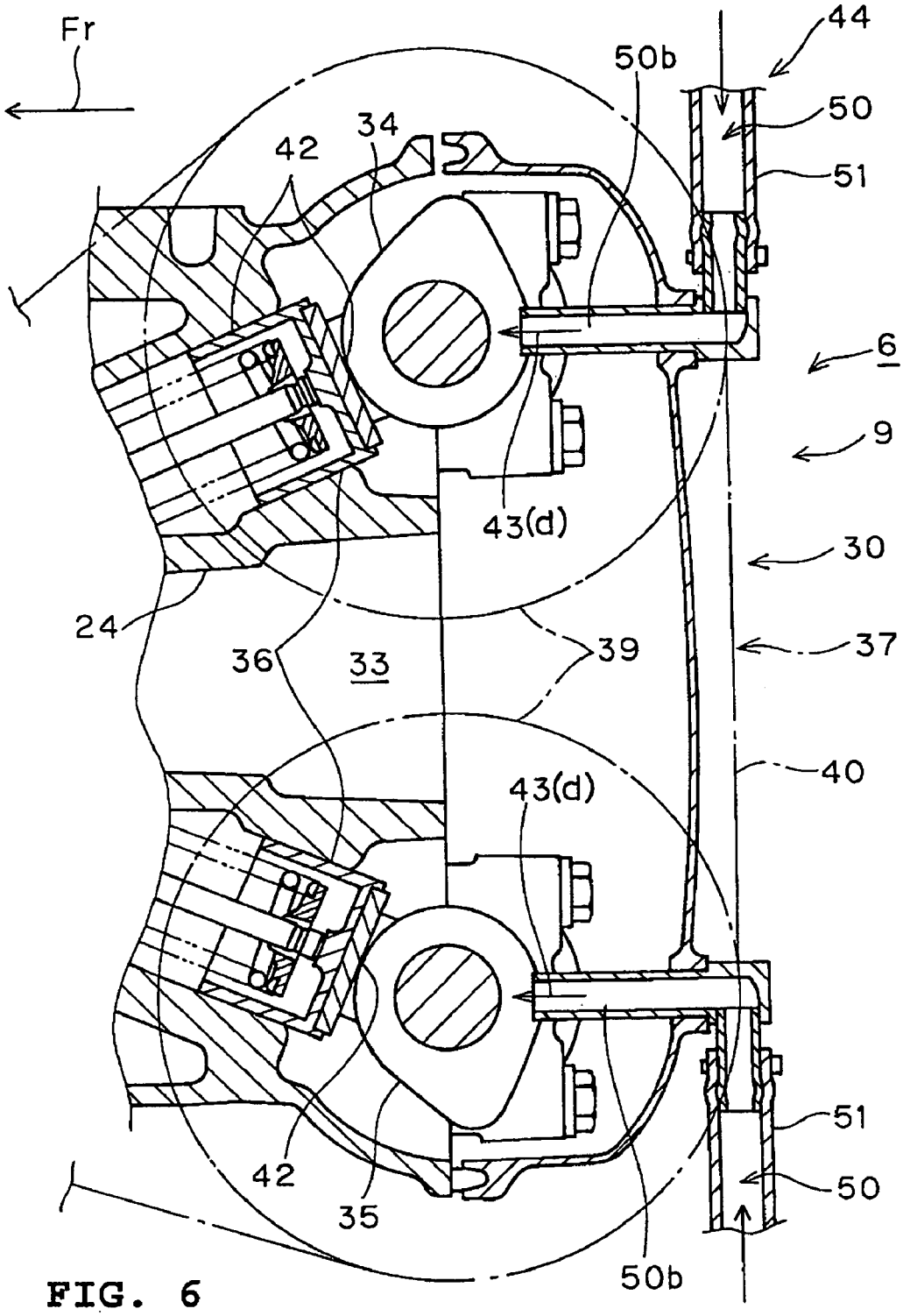
FIG. 6 is a cross-sectional view as seen in the direction of arrows 6—6 in FIG. 3.

In addition to or in the alternative, as shown in FIGS. 3 and 6, a downstream end 50*b* of the lubricant replenishing passage 50 may be made open to the cam chamber 33. Preferably, the downstream end 50*b* of the lubricant replenishing passage 50 is made open over the parts 42 to be lubricated. For example, the lubricant may be supplied to where the camshafts 34, 35 engage with the lifters 36. In this manner, the lubricant 43 that may be supplied through the lubricant replenishing passage 50 toward the lubricant pan 45 flows directly to the parts 42 to be lubricated. Therefore, irrespective of the internal combustion engine 9 being started or not, the cam engaging parts (i.e., examples of two of the parts 42 to be lubricated in the cam chamber 33) are lubricated immediately after the main switch 64 is turned on with the lubricant 43 supplied through the lubricant replenishing passage 50. In other words, the parts 42 to be lubricated are sufficiently lubricated from the start of the internal combustion engine 9. Subsequently, the lubricant 43 naturally flows down the cam chamber 33 to replenish the lubricant pan 45.

In addition to or in the alternative, as shown in FIGS. 2, 5 and 7, a downstream end 50*c* of the lubricant replenishing passage 50 may be made open to the region where the lubricant filler neck 52 is located and to the region on the inside surface side of the crankcase 15 partitioned with the baffle plate 54. The crankcase 15 is also provided with a lubricant return passage 67 (see FIG. 5) extending vertically. The lubricant return passage 67 allows natural flow of the lubricant 43 after it lubricates a bearing 19 supporting the top end part of the crankshaft 18 on the crankcase 15, which is typically one of the parts 42 to be lubricated, down toward the lubricant pan 45. A downstream end 50*d* of the lubricant replenishing passage 50 may also be made open to the lubricant return passage 67.

In addition to or in the alternative, as shown in FIG. 3, a downstream end 50*e* of the lubricant replenishing passage 50 may be made open to the region above the camshaft 34 (which is typically one of the parts 42 to be lubricated) so that the lubricant 43 supplied through the lubricant passage 50 toward the lubricant pan 45 flows directly to this part 42 to be lubricated, and the cam surface of the camshaft 34 is lubricated.

In addition to or in the alternative, as shown in FIGS. 7 and 8, a downstream end 50*f* of the lubricant replenishing passage 50 may be made open to the engagement parts of the mating gear set 41*d* of the balancer 41, so that the engagement parts of the mating gear set 41*d* and the mating gear set 41*c* are lubricated.

Figure 9:
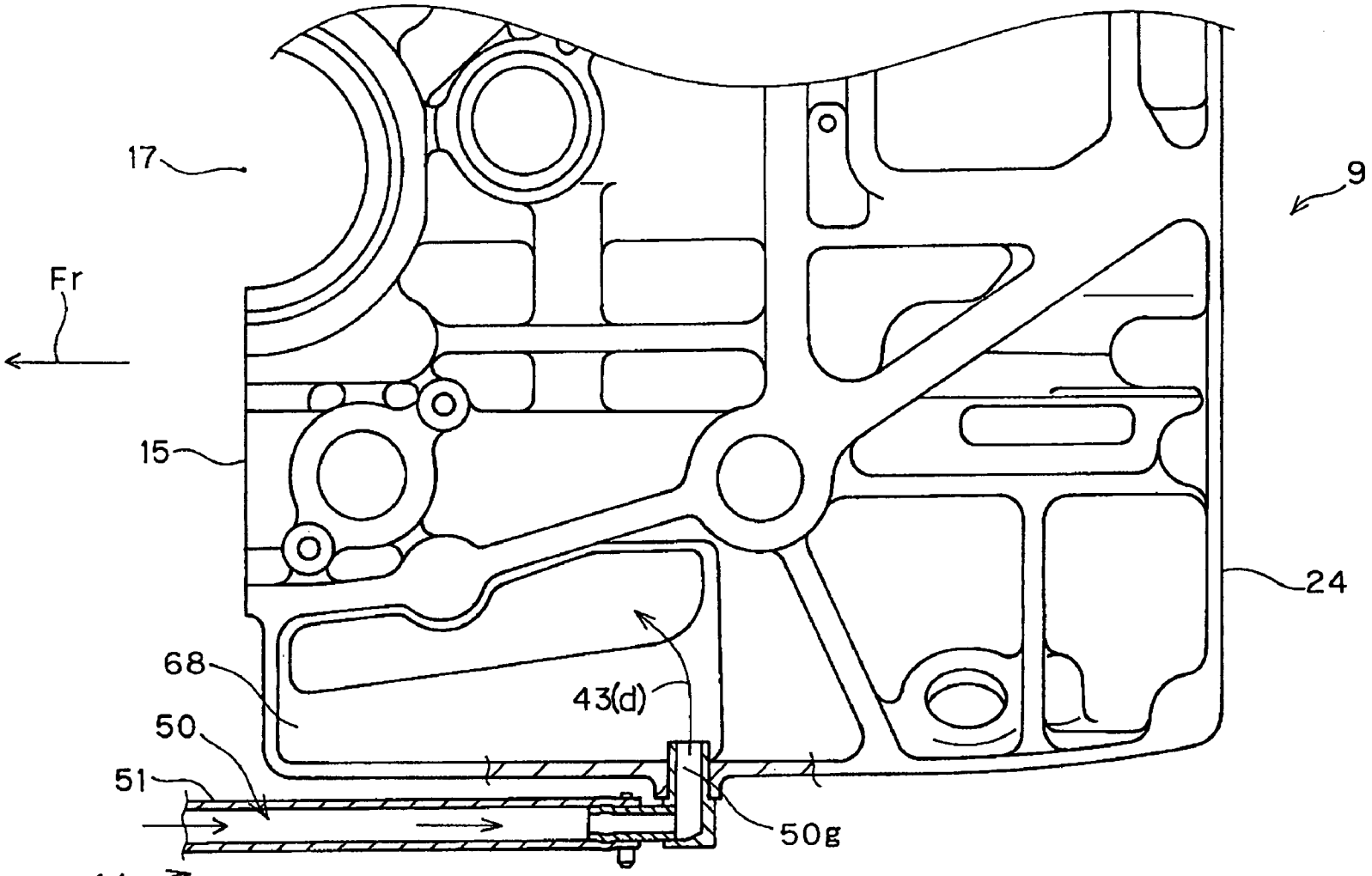
FIG. 9 is a cross-sectional view as seen in the direction of arrows 9—9 in FIG. 2.

In addition to or in the alternative, as shown in FIG. 9, the space 68 communicating with the lubricant pan 45 is formed in the cylinder 24, and a downstream end 50*g* of the lubricant replenishing passage 50 is made open to this space 68. This space 68 is a place where there is typically less air turbulence and pressure change due to the crankshaft 18. Thus, inflow of the lubricant 43 through the downstream end 50*g* of the lubricant replenishing passage 50 to the space 68 is made smooth. Subsequently the lubricant 43 naturally flows down the space 68 to replenish the lubricant pan 45. Therefore, the lubricant 43 is supplied smoothly from the lubricant tank 48 toward the lubricant pan 45.

It should be appreciated that the lubrication system may include one of the downstream ends 50*a* to 50*g* describe above and/or any combination thereof. In addition or in the alternative, the downstream ends of the lubricant replenishing passage 50 may open directly to the lubricant pan 45.

FIGS. 11 to 15 show additional embodiments for the downstream ends of the lubricant replenishing passages. Each of these embodiments has many points in common with the embodiments described above. Therefore, the common parts are provided with the same reference numerals and symbols on the drawings without redundant explanation. Instead, the differences between previous embodiments will be described. As with the previous embodiments, it should be appreciated that various parts of these embodiments may be combined with each other in the light of objects, functions and effects described herein.

Figure 11:
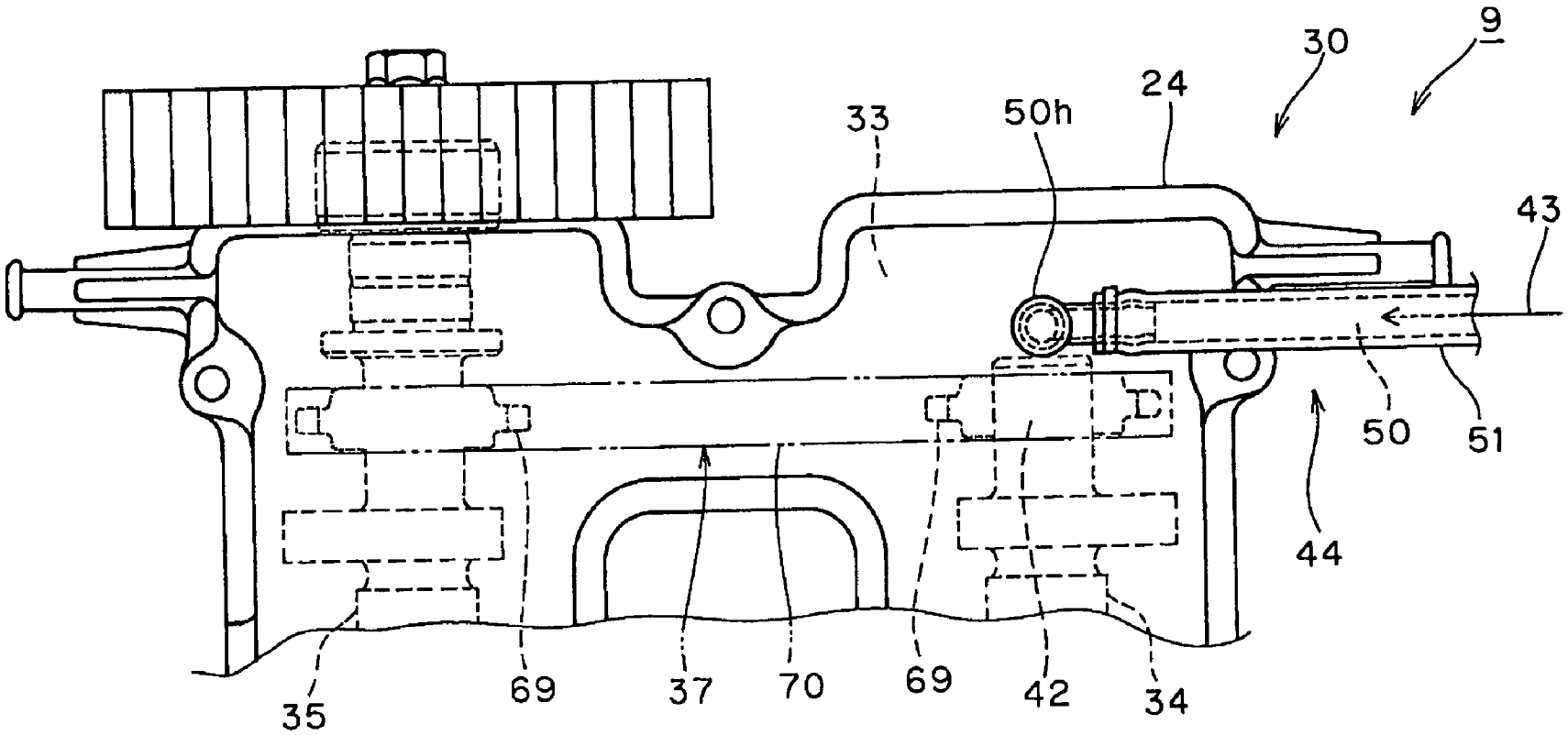
FIG. 11 is an enlarged, cross-sectional side view of a modified embodiment of the upper part of the engine shown in FIG. 3.
Figure 12:
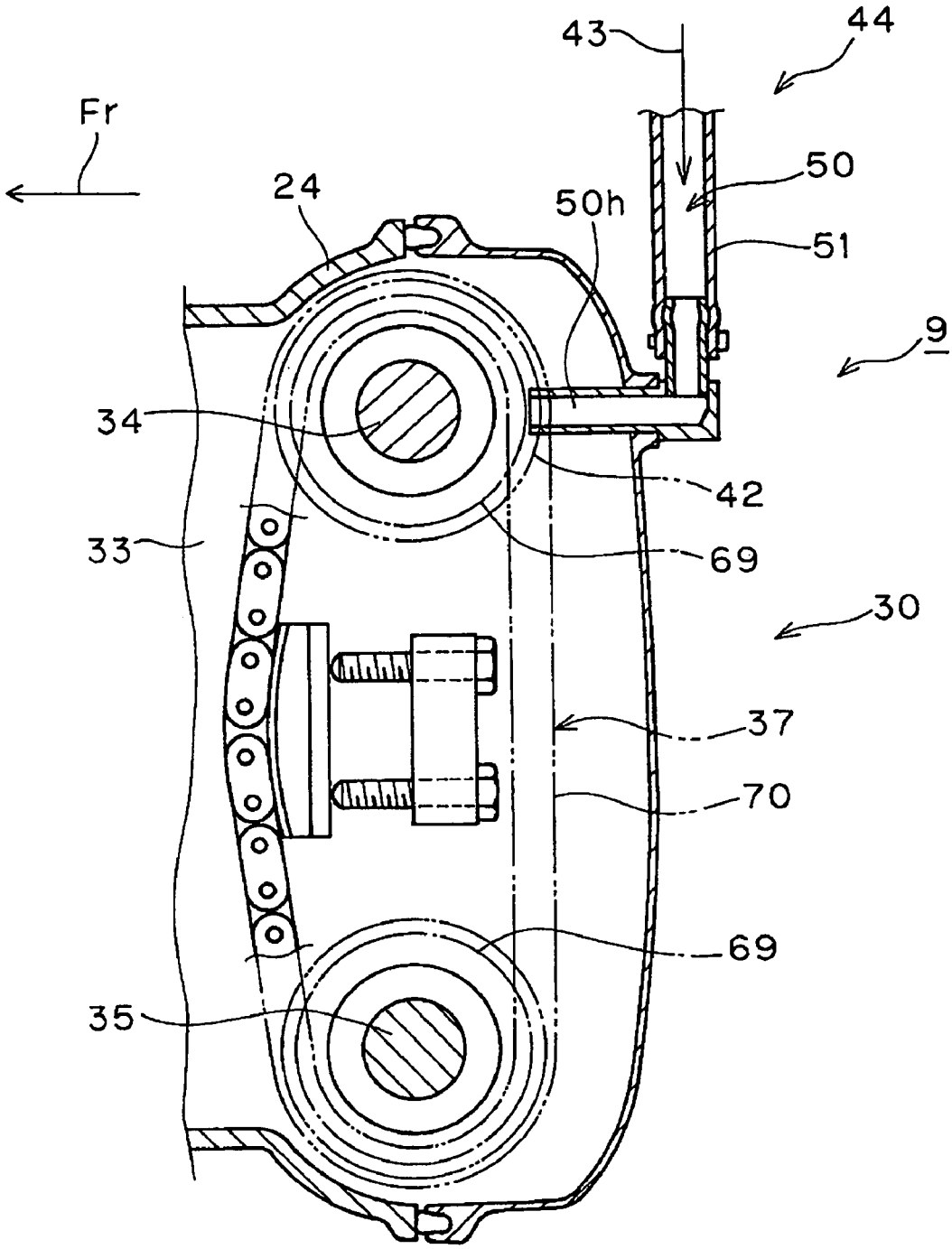
FIG. 12 is a top plan view of the modified embodiment of the portions of the engine shown in FIG. 11.

As shown in FIGS. 11 and 12, in this embodiment, one of the camshafts 34, 35 is interlocked with the crankshaft 18, while the camshafts 34, 35 are mutually interlocked through an interlock device 37. The interlock device 37 in the illustrated embodiment comprises sprocket wheels 69 attached respectively to the camshafts 34, 35, and a chain 70 fitted around the sprocket wheels 69, 69. The downstream end 50*h* of the lubricant replenishing passage 50 is made open to as to lubricate the regions where the sprocket wheels 69 engage with the chain 70. In this manner, the lubricant 43 is supplied toward the lubricant pan 45 through the lubricant replenishing passage 50 and goes directly to the parts 42 (i.e., the engagement regions) that are to be lubricated with lubricant 43. The lubricant 43 also lubricates the cam surfaces of the camshafts 34, 35.

Figure 13:
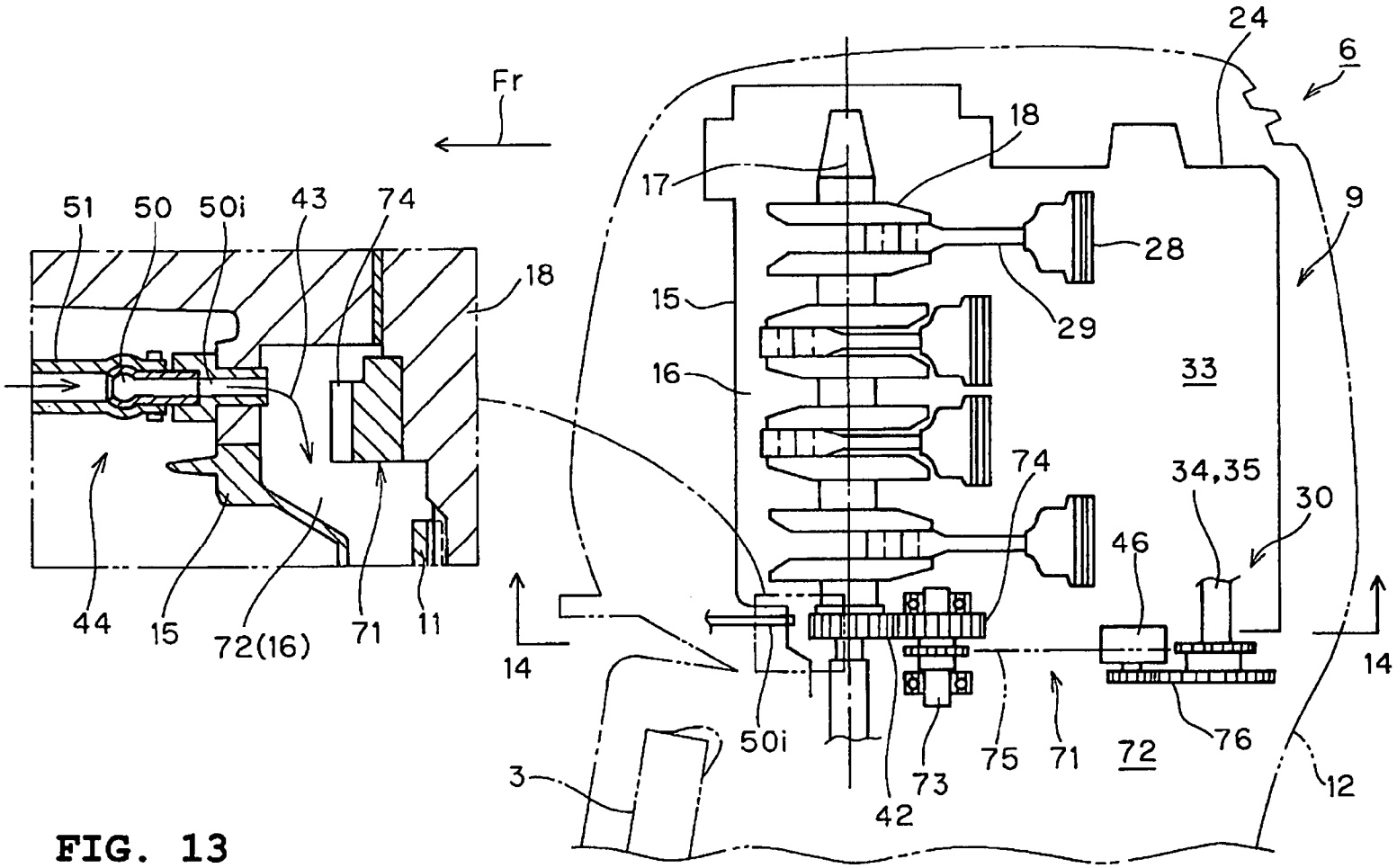
FIG. 13 is a schematic side and partial cross-sectional view of another embodiment of an outboard motor.
Figure 14:
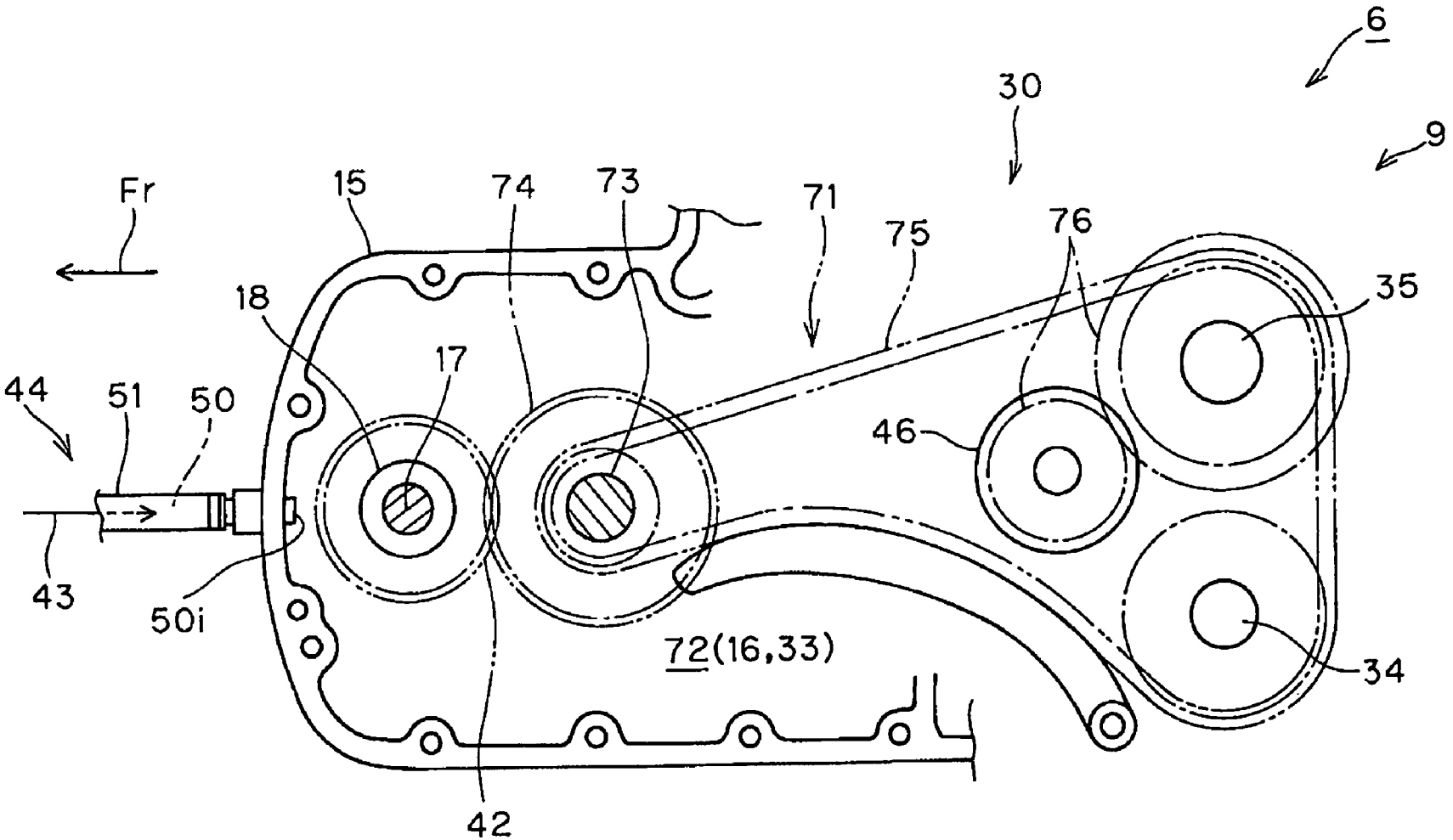
FIG. 14 is a cross-sectional view taken in the direction of arrows 14—14 in FIG. 13.

FIGS. 13 and 14 illustrate another embodiment of an interlock device 71 is provided for interlocking the camshafts 34, 35 with the crankshaft 18. In the illustrated arrangement, the interlock device 71 comprises an intermediate shaft 73 placed between the crankshaft 18 and the camshafts 34, 35 and supported with the crankcase 15 so as to be rotatable about its vertical axis. A mating gear set 74 is configured to interlock the intermediate shaft 73 with the crankshaft 18. A chain girdling 75 interlocks the camshafts 34, 35 with the intermediate shaft 73. The lower parts of the crank chamber 16 and the cam chamber 33 are made to be in mutual communication and they form a lower space 72 where the entire interlock device 71 is placed. Also in the lower space 72, the camshaft 34 is interlocked with the lubricant feeding pump 46 through a mating gear set 76.

In this embodiment, the downstream end 50*i* of the lubricant replenishing passage 50 is made open to the lower space 72 so that the lubricant 43 supplied through the lubricant replenishing passage 50 to the lubricant pan side goes directly to the parts 42 to be lubricated. In other words, the downstream end 50*i* is made open to one of the parts 42 to be lubricated, preferably an engaging region of the mating gear set 74 of the interlock device 71, so that the engaging region is lubricated with the lubricant 43.

Therefore, in this embodiment, irrespective of the internal combustion engine 9 being started or not, the interlock device 71, which is one of the parts 42 to be lubricated in the cam chamber 33, is lubricated immediately after the main switch 64 is turned on with the lubricant 43 supplied through the lubricant replenishing passage 50. In this manner, the parts 42 to be lubricated are sufficiently lubricated from the start of the internal combustion engine 9. Subsequently the lubricant 43 naturally flows down the lower space 72 to replenish the lubricant pan 45.

The lower space 72 is formed with the lower parts of the crank chamber 16 and the cam chamber 33 and results in being located in the vicinity of the lubricant pan 45. Therefore, the lubricant 43, after being supplied through the downstream end 50*i* of the lubricant replenishing passage 50 to the lower space 72, flows quickly to replenish the lubricant pan 45.

Figure 15:
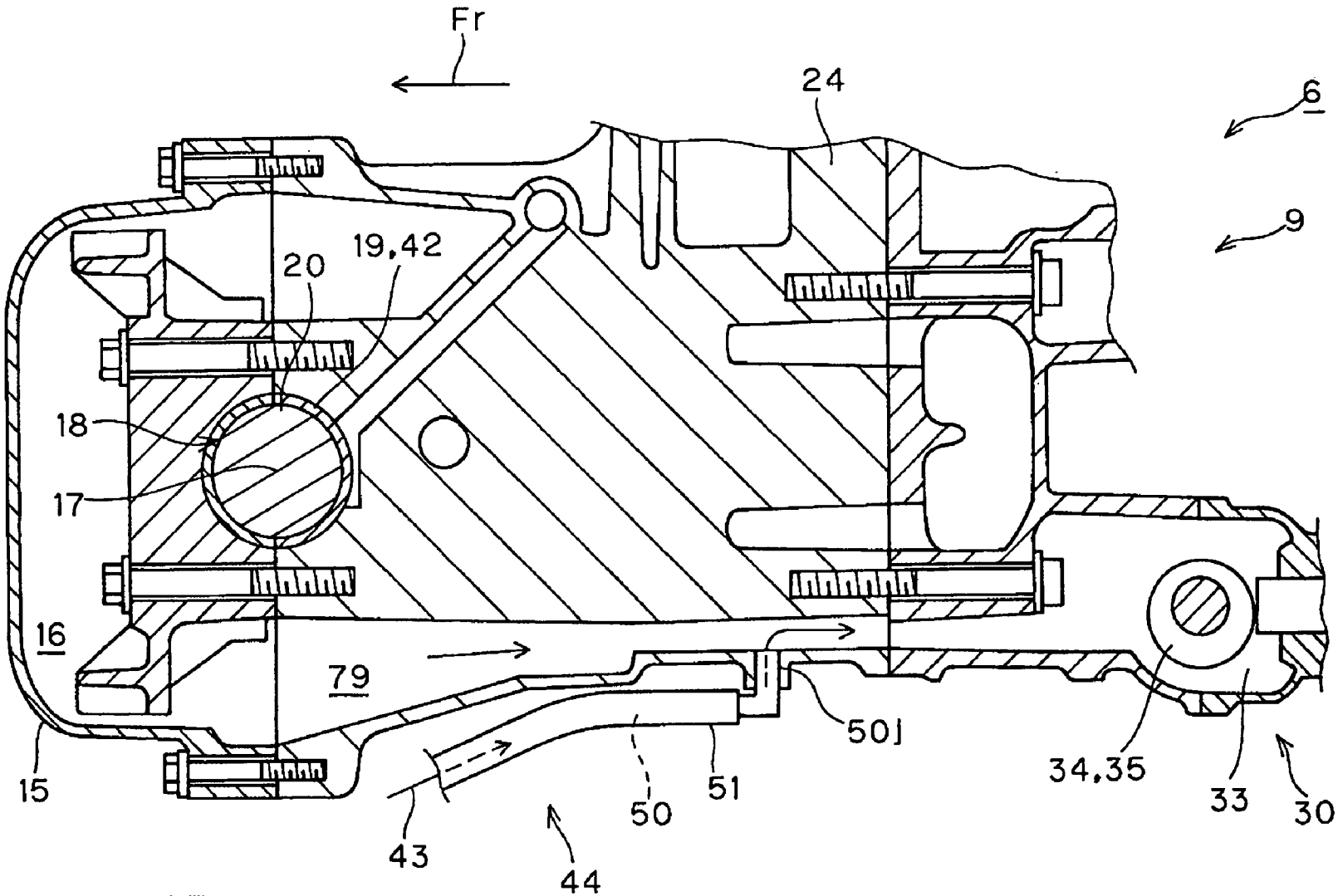
FIG. 15 is a partial cross-sectional view of a crank chamber of another embodiment of an engine.

FIG. 15 illustrates a blow-by gas passage 79 that may interconnect the crank chamber 16 with the cam chamber 33. In this embodiment, the downstream end 50*j* of the lubricant replenishing passage 50 is made open to the blow-by gas passage 79. Since the blow-by gas passage 79 is the place where less air turbulence and pressure change due to the crankshaft 18 are present, inflow of the lubricant 43 through the downstream end 50*j* of the lubricant replenishing passage 50 to the blow-by gas passage 79 is made smooth. Subsequently lubricant 43 naturally flows down from the blow-by gas passage 79 through at least one of the crank chamber 16 and the cam chamber 33 to replenish the lubricant pan 45. Therefore, the lubricant 43 is supplied smoothly from the lubricant tank 48 toward the lubricant pan 45.

Certain objects and advantages of the illustrated embodiment have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

In addition, although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional lubricant;

a lubricant replenishing pump configured to replenish the lubricant pan with additional lubricant from the lubricant tank;

a lubricant replenishing passage configured to lead the additional lubricant delivered from the lubricant replenishing pump toward the lubricant pan;

a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level; and a tilt angle sensor that is configured to detect a title angle of the main part of the outboard motor and wherein the control device is operatively connected to the tilt angle sensor and is configured to determine the specified replenishing amount of the lubricant according to the tilt angle detected with the tilt angle sensor.

2. The outboard motor of claim 1, wherein the specified replenishing amount of the lubricant is determined from the difference between the lubricant level detected with the lubricant level sensor and a predetermined upper limit level of the lubricant in the lubricant pan.

3. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional a lubricant replenishing pump configured to replenish the lubricant pan with additional lubricant from the lubricant tank;

a lubricant replenishing passage configured to lead the additional lubricant delivered from the lubricant replenishing pump toward the lubricant pan;

a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level; and an engine temperature sensor configured to detect the temperature of the internal combustion engine and wherein the control device is operatively connected to the engine temperature sensor and is configured to permit operation of the lubricant replenishing pump when the temperature detected with the engine temperature sensor is not higher than a specified temperature.

4. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional lubricant;

a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level;

wherein the control device is configured such that the specified replenishing amount of the lubricant is supplied from the lubricant tank toward the lubricant pan by operating the lubricant replenishing pump for a specified period of time.

5. The outboard motor of claim 4, additionally comprising a lubricant temperature sensor that is configured to detect the temperature of the lubricant in the lubricant tank, and control device is configured such that the specified period of time for operating the lubricant replenishing pump is compensated according to the temperature of the lubricant detected with the lubricant temperature sensor.

6. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine;

a lubricant tank disposed separately from the lubricant pan to reserve additional lubricant;

a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level, wherein a downstream end of the lubricant replenishing passage is in communication with a part of the internal combustion to lubricant the part of the engine before draining towards the lubricant pan.

7. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional lubricant;

a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level;

wherein the internal combustion engine comprises a crankcase which has a crank chamber located generally above the lubricant pan and is in communication with the lubricant pan, and a crankshaft which is supported for rotation about its axis with the crankcase and placed within the crank chamber, and wherein a downstream end of the lubricant replenishing passage opens to a radially outside region of a main shaft of the crankshaft in the crank chamber.

8. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level;

wherein the internal combustion engine includes a cam chamber and a downstream end of the lubricant replenishing passage communicates with the cam chamber.

9. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant van to reserve additional a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level;

wherein the internal combustion engine comprises a crankcase and a cylinder projecting generally horizontally from the crankcase and located above the lubricant pan, and wherein a space in communication with the lubricant pan is formed in the cylinder, and a downstream end of the lubricant replenishing passage opens at the space.

10. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional lubricant;

a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level; and wherein the internal combustion engine comprises a crankcase, a crankshaft accommodated in and supported with the crankcase so as to be rotatable about a substantially vertical axis when the engine is in a substantially horizontal position, a cylinder projecting generally horizontally from the crankcase, camshafts accommodated in a cam chamber formed in the projecting part of the cylinder, and a transmitter for interlocking the camshafts with the crankshaft, and wherein the transmitter is placed in a lower space formed with lower parts of the crank chamber and the cam chamber, and a downstream end of the lubricant replenishing passage opens to the lower space.

11. An outboard motor comprising:

a main part, the main part including an internal combustion engine, a lubricant pan for reserving a lubricant for lubricating the engine, a lubricant level sensor for detecting the level of the lubricant in the lubricant pan, and a main switch for turning on and off a power supply to the internal combustion engine, the lubricant pan being positioned below the internal combustion engine and being configured to collect the lubricant that has drained towards the lubricant pan from the internal combustion engine;

a lubricant tank disposed separately from the lubricant pan to reserve additional lubricant;

a lubricant replenishing pump configured to replenish the lubricant pan with additional lubricant from the lubricant tank;

a lubricant replenishing passage configured to lead the additional lubricant delivered from the lubricant replenishing pump toward the lubricant pan; and a control device operatively connected to the lubricant level sensor and the lubricant replenishing pump, the control device configured to detect the lubricant level upon the main switch being turned on and to supply lubricant by the operation of the lubricant replenishing pump from the lubricant tank through the lubricant replenishing passage toward the lubricant pan by a specified replenishing amount according to the lubricant level;

wherein the internal combustion engine comprises a blow-by gas passage configured to communicate between a crank chamber and a cam chamber, and wherein a downstream end of the lubricant replenishing passage opens into the blow-by gas passage.

12. A method of replenishing lubricant to a lubricant pan of an outboard motor engine, the method comprising:

before lubricant from the lubricant pan is supplied to parts of the engine, detecting the lubricant level within the lubricant pan;

calculating a specified replenishing amount of lubricant according to the lubricant level;

activating a lubricant pump positioned within a lubricant tank disposed separately from the lubricant pan; and supplying the specified replenishing amount of lubricant to the lubricant pan through a lubricant replenishing passage;

lubricating a part of the internal combustion engine with the lubricant;

collecting the lubricant in the lubricant pan;

detecting a temperature of the engine and permitting the operation of the lubricant pump only if the engine temperature is not higher than a specified temperature.

13. The method of claim 12, wherein detecting the lubricant level within the lubricant pan is initiated in response to a main switch of the engine being activated.

14. The method of claim 12, wherein calculating a specified replenishing amount of lubricant according to the lubricant comprises determining the difference between the lubricant level detected and a predetermined upper limit level of the lubricant in the lubricant pan.

15. The method of claim 12, additionally comprising detecting a tilt angle of a main part of the outboard motor engine and determining the specified replenishing amount of the lubricant according to the tilt angle detected.

16. The method of claim 12, wherein supplying the specified replenishing amount is comprises operating the lubricant pump for a specified period of time.

17. A method of replenishing lubricant to a lubricant pan of an outboard motor engine, the method comprising:

before lubricant from the lubricant pan is supplied to parts of the engine, detecting the lubricant level within the lubricant pan;

calculating a specified replenishing amount of lubricant according to the lubricant activating a lubricant pump positioned within a lubricant tank disposed separately from the lubricant pan; and supplying the specified replenishing amount of lubricant to the lubricant tank through a lubricant replenishing passage, wherein supplying the specified replenishing amount is comprises operating the lubricant pump for a specified period of time;

lubricating a part of the internal combustion engine with the lubricant;

collecting the lubricant in the lubricant pan; and detecting the temperature of the lubricant in the lubricant tank, and adjusting the specified period of time for operating the lubricant pump according to the temperature of the lubricant detected.

18. A method of replenishing lubricant to a lubricant pan of an outboard motor engine, the method comprising:

before lubricant from the lubricant pan is supplied to parts of the engine, detecting the lubricant level within the lubricant pan;

calculating a specified replenishing amount of lubricant according to the lubricant level;

activating a lubricant pump positioned within a lubricant tank disposed separately from the lubricant pan; and supplying the specified replenishing amount of lubricant to the lubricant pan through a lubricant replenishing passage; and lubricating a part of the internal combustion engine with at least a portion of the specified replenishing amount of lubricant before the specified replenishing amount of lubricant is delivered to the lubricant pan.

* * * * *

UNITED STATES PATENT AND TRADEMARK OFFICE

CERTIFICATE OF CORRECTION

PATENT NO. : 7,118,435 B2
APPLICATION NO. : 10/999029
DATED : October 10, 2006
INVENTOR(S) : Takahashi et al.

It is certified that error appears in the above-identified patent and that said Letters Patent is hereby corrected as shown below:

On Title page 1, column 1, after section "(65)", please insert

--(30) Foreign Application Priority Data

November 27, 2003 (JP) .....2003-396694--

At column 3, line 15, after "disclosed" please insert --.--

At column 8, line 29, before "axial" please delete "a" and insert --an--, therefore At column 18, line 4, in Claim 1, please delete "title" and insert --tilt--, therefore At column 18, line 28 (approximate), in Claim 3, after "additional" please insert --lubricant--

At column 18, lines 28-30, in Claim 3, please delete "a lubricant replenishing.....lubricant tank;" and insert the same on line 29 as next paragraph At column 20, line 37, in Claim 8, after "additional" please insert --lubricant;

At column 20, lines 37-39, in Claim 8, please delete "a lubricant replenishing.....lubricant tank;" and insert the same on line 38 as next paragraph At column 20, line 67, in Claim 9, please delete "van" and insert --pan--, therefore At column 20, line 67, in Claim 9, after "additional" please insert --lubricant--

At columns 20-21, lines 67- 2 (col. 20 - 21), please delete "a lubricant replenishing.....lubricant tank;" and insert the same on line 1 (col. 21) as next paragraph

UNITED STATES PATENT AND TRADEMARK OFFICE

CERTIFICATE OF CORRECTION

PATENT NO. : 7,118,435 B2
APPLICATION NO. : 10/999029
DATED : October 10, 2006
INVENTOR(S) : Takahashi et al.

It is certified that error appears in the above-identified patent and that said Letters Patent is hereby corrected as shown below:

At column 21, line 60, in Claim 10, before "crank chamber" please delete "the" and insert --a--, therefore At column 22, line 61, in Claim 16, after "amount" please delete "is"

At column 23, line 2, in Claim 17, after "lubricant" please insert --level--

At column 23, lines 2-4, in Claim 17, please delete "activating a lubricant.....lubricant pan; and" insert the same on line 3 as a new paragraph At column 23, line 6, in Claim 17, please delete "tank" and insert --pan--, therefore At column 23, line 8, in Claim 17, after "amount" please delete "is"

At column 24, line 8, in Claim 18, after "pan;" please delete "and"

Signed and Sealed this

First Day of May, 2007

JON W. DUDAS
*Director of the United States Patent and Trademark Office*